US008765343B2

(12) United States Patent
Takamiya et al.

(10) Patent No.: US 8,765,343 B2
(45) Date of Patent: Jul. 1, 2014

(54) ELECTROSTATIC LATENT IMAGE DEVELOPING TONER, ELECTROSTATIC LATENT IMAGE DEVELOPING TONER MANUFACTURING METHOD, TONER CARTRIDGE, IMAGE FORMING METHOD, AND IMAGE FORMING APPARATUS

(75) Inventors: Yuki Takamiya, Kanagawa (JP); Eisuke Iwazaki, Kanagawa (JP); Satoshi Yoshida, Kanagawa (JP); Satoshi Inoue, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 13/368,729

(22) Filed: Feb. 8, 2012

(65) Prior Publication Data

US 2013/0071782 A1 Mar. 21, 2013

(30) Foreign Application Priority Data

Sep. 20, 2011 (JP) ..... 2011-204739

(51) Int. Cl.
*G03G 9/08* (2006.01)

(52) U.S. Cl.
USPC ..... 430/108.1; 430/105; 430/108.6; 430/137.1; 430/137.18; 430/137.2; 399/168; 399/177; 399/222; 399/252; 399/297

(58) Field of Classification Search
CPC ..... G03G 9/0926; G03G 9/09708; G03G 9/0902; G03G 9/08; G03G 9/00; G03G 9/09
USPC ..... 430/96–110.4, 105, 108.1, 108.6, 430/137.1, 137.18, 137.2; 399/168, 177, 399/222, 252, 297
See application file for complete search history.

(56) References Cited

U.S. PATENT DOCUMENTS

| | | | | |
|---|---|---|---|---|
| 5,135,832 | A * | 8/1992 | Sacripante et al. | 430/106.2 |
| 5,240,814 | A * | 8/1993 | Held | 430/291 |
| 2009/0214972 | A1* | 8/2009 | Wosnick et al. | 430/108.2 |
| 2009/0243467 | A1* | 10/2009 | Shimizu et al. | 313/503 |
| 2010/0075241 | A1* | 3/2010 | Kazmaier et al. | 430/107.1 |
| 2011/0143274 | A1 | 6/2011 | Iftime et al. | |
| 2012/0167666 | A1* | 7/2012 | Nair et al. | 73/38 |
| 2013/0071782 | A1 | 3/2013 | Takamiya et al. | |

FOREIGN PATENT DOCUMENTS

| | | | | |
|---|---|---|---|---|
| JP | A-2002-3835 | | 1/2002 | |
| JP | 2006-233052 | * | 9/2006 | C09K 11/81 |
| JP | 2007-017719 | * | 1/2007 | |
| JP | A-2008-287239 | | 11/2008 | |
| JP | A-2009-205157 | | 9/2009 | |

OTHER PUBLICATIONS

U.S. Appl. No. 13/542,085 in the name of Takamiya et al., filed Jul. 5, 2012.
Oct. 31, 2013 Office Action issued in U.S. Appl. No. 13/542,085.
Mar. 4, 2014 Office Action issued in U.S. Appl. No. 13/542,085.

* cited by examiner

*Primary Examiner* — Christopher Rodee
*Assistant Examiner* — Omar Kekia
(74) *Attorney, Agent, or Firm* — Oliff PLC

(57) ABSTRACT

An electrostatic latent image developing toner contains a binder resin, a colorant, europium, and bismuth.

12 Claims, 3 Drawing Sheets

ELECTROSTATIC LATENT IMAGE DEVELOPING TONER, ELECTROSTATIC LATENT IMAGE DEVELOPING TONER MANUFACTURING METHOD, TONER CARTRIDGE, IMAGE FORMING METHOD, AND IMAGE FORMING APPARATUS

CROSS-REFERENCE TO RELATED APPLICATIONS

This application is based on and claims priority under 35 USC 119 from Japanese Patent Application No. 2011-204739 filed Sep. 20, 2011.

BACKGROUND

1. Technical Field

The present invention relates to an electrostatic latent image developing toner, an electrostatic latent image developing toner manufacturing method, a toner cartridge, an image forming method, and an image forming apparatus.

2. Related Art

Currently, methods of visualizing image information through an electrostatic latent image, such as electrophotography, are used in various fields.

Hitherto, in electrophotography, a method of performing visualization through plural processes including: forming an electrostatic latent image on a photoreceptor or an electrostatic recording body by using various means; adhering electric detection particles, referred to as toner, to the electrostatic latent image to develop an electrostatic latent image (toner image); transferring the image onto the surface of a transfer medium; and fixing the image by heating or the like is generally used.

In recent years, coloring processing has promoted even in copiers, printers and the like, and color toners having excellent color reproducibility are required.

SUMMARY

According to an aspect of the invention, there is provided an electrostatic latent image developing toner containing a binder resin, a colorant, europium, and bismuth.

BRIEF DESCRIPTION OF THE DRAWINGS

Exemplary embodiments of the present invention will be described in detail based on the following figures, wherein.

DETAILED DESCRIPTION

Electrostatic Latent Image Developing Toner

Figure 1:
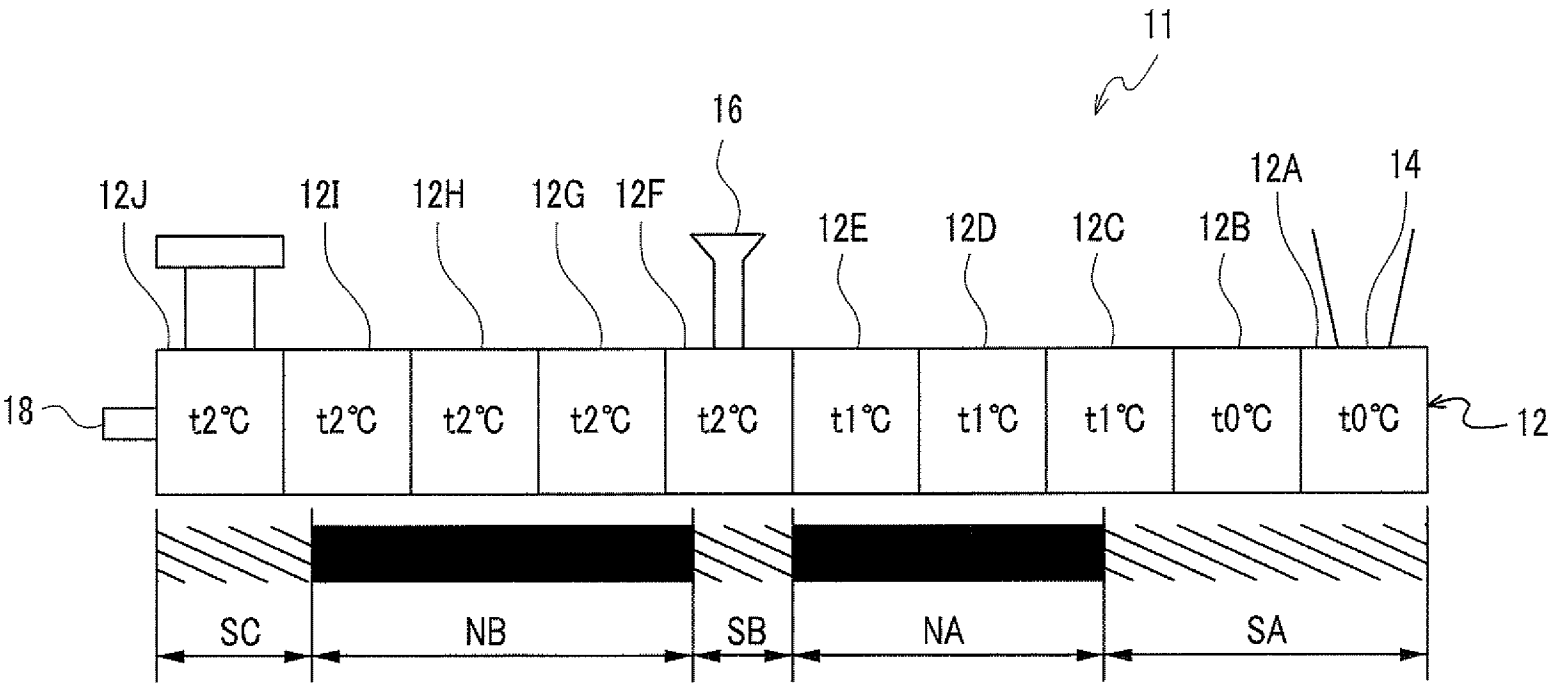
FIG. 1 is a diagram illustrating a state of a screw of a screw extruder that is appropriately used in the manufacturing of an electrostatic latent image developing toner according to an exemplary embodiment.

An electrostatic latent image developing toner (hereinafter, may be simply referred to as "toner") according to an exemplary embodiment contains a binder resin and a colorant, and further contains (A) europium and (B) bismuth.

In this exemplary embodiment, "from X to Y" represents a range including not only a range between X and Y, but also X and Y at both ends of the range. For example, when "from X to Y" is a numerical range, it represents "equal to or greater than X and equal to or less than Y", or "equal to or greater than Y and equal to or less than X" in accordance with the sizes of the numerical values.

Hitherto, in order to widen a color reproduction region of an image, as described in JP-A-2008-287239 and JP-A-2009-205157, a toner having a fluorescent agent internally added thereto has been developed. However, a coumarin derivative and the like that are used in JP-A-2008-287239 have a short emission lifetime and are insufficient in color retentivity. In addition, a lanthanide complex that is used in JP-A-2009-205157 has a longer emission lifetime than the coumarin derivative, but is insufficient in color developability.

The inventors and the like have conducted intensive studies, and as a result, found that when the toner contains a particular element, an electrostatic latent image developing toner having excellent color developability and high color retentivity may be obtained, and completed the invention.

The mechanism thereof is not necessarily clear, but is thought to act as follows. That is, normally, a colorant that is used in a magenta toner is sensitive to ultraviolet wavelength light, and discoloration occurs. It is thought that due to the containing of europium, the elements absorb and emit ultraviolet wavelength light, and thus the color of the colorant is maintained for a long period of time. On the other hand, europium has a discoloration problem with respect to the light beams of a visible light region. In this exemplary embodiment, it is thought that by appropriately adding bismuth, the light beams of the visible light region are reflected and the arrival of the visible light to europium is inhibited, and thus the stability of europium is improved.

In addition, since europium emits light by ultraviolet wavelength light, the inhibition of the light emission by bismuth is not a problem. Moreover, since bismuth reflects the light emitted from europium and the like, it is supposed that the light emission luminance is amplified and the color developability is improved.

In this exemplary embodiment, the color developability shows "color reproducibility in an output image, and here means that as an image obtained by copying a Japan color standard printing patch for sheet-fed printing has a value (ΔE) closer to that of an original patch, higher color development, higher color gamut, and higher color reproducibility are obtained". The high color retentivity shows that "how long the degree of color development of a formed image may be maintained, and here means that as ΔE after keeping of the image obtained by copying a Japan color standard printing patch for sheet-fed printing for 10 days under a high-strength white lamp is closer to ΔE of the original copied image, higher color retentivity is obtained".

Hereinafter, the components of the toner will be described in detail.

<(A) Europium and (B) Bismuth>

The toner according to this exemplary embodiment necessarily contains (A) europium (hereinafter, may be referred to as the element A) and (B) bismuth (hereinafter, may be referred to as the element B).

When the content of the element A in the toner measured by fluorescent X-ray analysis is denoted by A (% by weight), A is preferably from 0.2% by weight to 7.0% by weight (or from about 0.2% by weight to about 7.0% by weight). Since the color developability in an obtained image becomes excellent and high color retentivity are obtained, it is desirable that the content (A) of the element A in the toner be 0.2% by weight or greater. In addition, when the content is 7.0% by weight or less, the toner is easily formed.

The content of A is more preferably from 0.7% by weight to 1.5% by weight, and even more preferably from 1.0% by weight to 1.2% by weight. When the content of A is in the above range, the color developability in an obtained image becomes more excellent and higher color retentivity is obtained. Furthermore, the toner is more easily formed.

When the content of the element B in the toner measured by fluorescent X-ray analysis is denoted by B (% by weight), B is preferably from 0.02% by weight to 0.7% by weight (or from about 0.02% by weight to about 0.7% by weight). Since the color developability in an obtained image becomes excellent and high color retentivity is obtained, it is desirable that the content (B) of the element B in the toner be 0.02% by weight or greater. In addition, since the toner is easily formed, it is desirable that the content be 0.7% by weight or less.

The content of B is more preferably from 0.04% by weight to 0.4% by weight, and even more preferably from 0.06% by weight to 0.2% by weight. When the content of B is in the above range, the color developability in an obtained image becomes more excellent and higher color retentivity is obtained. Furthermore, the toner is more easily formed.

When the content of the element A in the toner measured by fluorescent X-ray analysis is denoted by A (% by weight) and the content of the element B in the toner is denoted by B (% by weight), A/B is preferably from 3 to 20 (or from about 3 to about 20). Since more excellent color retentivity is obtained, it is desirable that A/B be in the above range.

The A/B is more preferably from 5 to 15, and even more preferably from 8 to 11.

Here, the content A (% by weight) of the element A in the toner by fluorescent X-ray analysis and the content B (% by weight) of the element B in the toner are measured by the following method. Using a scanning fluorescent X-ray analyzer (Rigaku ZSX Primus II), a disk having a toner amount of 0.130 g is molded, the measurement is performed by a qualitative and quantitative total elemental analysis method under the conditions of a X-ray output of from 40 to 70 mA, a measurement area of 10 mmϕ, and a measurement time of 15 minutes, and the analysis values of EuLα and BiLα of the data are set as the element amounts according to this exemplary embodiment. When the peak overlaps with a peak of another element, it is analyzed by ICP emission spectroscopy or an atomic absorption method, and then the analysis values of the content of europium and the content of bismuth are obtained.

When the toner according to this exemplary embodiment contains the elements A and B, the form of the containing is not particularly limited. However, it is desirable that the toner contains a complex containing the elements A and B.

It is desirable that the complex be a complex in which activated oxide with the element A set as an emission center (activator) is further coactivated with the element B (bismuth). The activated oxide with the element A set as an activator is a crystalline oxide matrix activated with the element A. The crystalline oxide matrix is not particularly limited if it is chemically stable, examples thereof include barium (Ba), calcium (Ca), magnesium (Mg), strontium (Sr), silicon (Si), boron (B), phosphorus (P), aluminum (Al), gallium (Ga), iron (Fe), copper (Cu), silver (Ag), nickel (Ni), palladium (Pd), cobalt (Co), tin (Sn), molybdenum (No), tungsten (W), zirconium (Zr), hafnium (Hf), zinc (Zn), titanium (Ti), manganese (Mn), vanadium (V), niobium (Nb), tantalum (Ta), antimony (Sb), bismuth (Bi), scandium (Sc), yttrium (Y), indium (In), lanthanum (La), and oxides and composite oxides of rare-earth elements and the like.

The element A activated with the crystalline oxide matrix corresponds to emission center ions, and is preferably substituted in the range of from 1.0 atm % to 20.0 atm % with respect to the total number of metallic ions in the crystalline oxide matrix. When the content of the element A is in the above range, sufficient luminous efficiency is obtained. The range is more preferably from 3.0 atm % to 10.0 atm %, and even more preferably from 5.0 atm % to 8.0 atm %.

The complex containing the elements A and B is not particularly limited, and examples thereof include $Y_2O_3$:A,B, $Y(P_x,V_{1-x})O_4$:A,B, ($0 \leq x < 1$), $Y_2O_2S$:A,B, $Y_2SiO_5$:A,B, $Y_3Al_5O_{12}$:A, B, $YBO_3$:A,B, $Y_xGd_yBO_3$:A,B ($x+y=1$), $GdBO_3$:A,B, $ScBO_3$:A,B, $LuBO_3$:A,B, and $LaPO_4$:A,B. A represents europium, and B represents bismuth.

Among them, $Y_2O_3$:A,B or $Y(P_x,V_{1-x})O_4$:A,B is preferably used, and a complex expressed by the following Formula (1) is particularly preferably used.

$$YVO_4:A,B \quad (1)$$

The method of manufacturing a complex containing the elements A and B is not particularly limited. The complex may be synthesized by a dry method or a wet method.

Hereinafter, a dry manufacturing method will be described with $Y_2O_3$:Eu,Bi as an example. Each of raw material powders of $Y_2O_3$, $Eu_2O_3$ and $Bi_2O_3$ is weighed to a predetermined amount so as to obtain a predetermined composition. Then, the powders are sufficiently mixed using a ball mill or the like with an appropriate fusion agent such as $BaF_2$. When the raw material mixture is put into an alumina crucible and baked for about from 1 to 6 hours at a temperature of about from 1,000 to 1,600° C. in the atmosphere, a fluorescent body of yttrium oxide coactivated with $Eu^{3+}$ and $Bi^{3+}$ may be obtained.

In addition, a wet manufacturing method will be described with $YVO_4$:A,B as an example. A method including: dissolving a yttrium compound and a compound containing the element A by a complex forming compound in the presence of water to form a first solution; dissolving or dispersing a vanadium compound in water to form a second solution or dispersion; and mixing and reacting the first solution and the second solution or dispersion is exemplified with reference to, for example, the pamphlet of WO2008/093845.

In addition, as a wet manufacturing method for $Y_2O_3$:A,B, a method of reacting a yttrium compound, a compound containing the element A and a compound containing the element B in the presence of a solvent such as alcohols and monomethyl ethers thereof and a particle size adjuster such as polyvinyl alcohol is exemplified with reference to, for example, JP-A-2008-189762.

In this exemplary embodiment, it is desirable that the toner particularly takes on a magenta color. When the element A is europium, the color of fluorescence that is emitted by the absorption of ultraviolet light is red, and thus the color developability of the magenta color may be improved. In addition, since a magenta pigment absorbs ultraviolet light, there is a problem in that the blueness in a formed image is weak. Accordingly, when europium having high ultraviolet light absorption capability is contained, the absorption of ultraviolet light by a magenta pigment may be suppressed, and a colorful image is formed.

Examples of the complex containing europium and bismuth include $Y_2O_3$:Eu,Bi, $YVO_4$:Eu,Bi, and $Y_2O_2S$:Eu,Bi. Among them, $Y_2O_3$:Eu,Bi and $YVO_4$:Eu,Bi are preferably used, and $YVO_4$:$Eu^{3+}$,$Bi^{3+}$ is more preferably used.

The volume average particle size of particles of the complex containing the elements A and B (hereinafter, may be referred to as "complex powder" or "complex particles") is preferably from 5 nm to 2,000 nm, more preferably from 5 nm to 1,000 nm, and even more preferably from 5 nm to 500 nm.

Since excellent dispersibility in the toner is obtained and the particle surface area increases, and thus the luminous efficiency increases, it is desirable that the volume average particle size of the complex powder be in the above range.

<(C) Tin and/or Titanium>

It is desirable that the electrostatic latent image developing toner according to this exemplary embodiment contains (C) tin and/or titanium (hereinafter, may be referred to as the element C) in addition to the above-described (A) europium and (B) bismuth. When tin and/or titanium is contained in the toner, the luminous efficiency of the europium complex is improved.

While europium emits light by ultraviolet light, the binder resin (desirably polyester resin) of the toner also has an ultraviolet light absorption property since it has a functional group (carbon-carbon double bond, carbon-oxygen double bond and the like) absorbing light in the ultraviolet region. Therefore, since a polyester resin, the content of which is large in the toner composition, absorbs ultraviolet light, fluorescence emission of the europium complex by the ultraviolet light is inhibited. Accordingly, when tin and/or titanium is contained in the polyester resin, the ultraviolet light absorption of the polyester resin spreads, and thus the europium complex efficiently absorbs ultraviolet light and the luminous efficiency of the fluorescence increases.

When the content of europium in the toner measured by fluorescent X-ray analysis is denoted by A (% by weight) and the content of the element C in a cross-section of the toner that is observed by transmission electron microscope energy dispersive X-ray analysis is denoted by C (% by weight), A/C is preferably from 3 to 20 (or from about 3 to about 20). When A/C is in the above range, the element C is uniformly dispersed in the resin and the ultraviolet light absorption of the resin is effectively inhibited.

A/C is more preferably from 5 to 15, and even more preferably from 8 to 11.

The content C (% by weight) of the element C in the toner by transmission electron microscope energy dispersive X-ray analysis is measured by the following method. The toner is embedded in an epoxy resin and frozen by a cryostat, and a thin film is cut out. It is observed using transmission electron microscope-energy dispersive X-ray analysis (TEM-EDX) at an accelerating voltage of 10 kV for an integrated time of 30 minutes. From the obtained toner cross-section observation photography (ten-thousand-fold), the amount of the element C is analyzed using an image analyzer.

The element C may be contained as any compound in the toner. However, when a polyester resin is used as a binder resin to be described later, it is appropriate that the element C is added as a catalyst for when the polyester resin is synthesized.

Examples of a tin compound suitable as a catalyst include tin formate, tin oxalate, tetraphenyltin, dibutyltin dichloride, dibutyltin oxide, diphenyltin oxide, dioctyl tin oxide and monobutyltin oxide. Examples of a titanium compound include titanium tetraethoxide, titanium tetrapropoxide, titanium tetraisopropoxide and titanium tetrabutoxide.

<Binder Resin>

The toner contains a binder resin.

In this exemplary embodiment, a polyester resin is preferably used as a binder resin. Since a polyester resin has hydrophilicity, it is dispersed well when the toner is formed, and the europium complex may be more uniformly taken in the toner base particles. Therefore, a polyester resin is preferably used.

Preferable examples of a polycondensation resin include a polyester resin, a polyamide resin and the like, and particularly, a polyester resin that is obtained using a material containing polyol and polyvalent carboxylic acid as a polycondensable monomer is preferably used.

Examples of the polycondensable monomer that may be used in this exemplary embodiment include polyvalent carboxylic acid, polyol, hydroxyl carboxylic acid, polyamine, and mixtures thereof. Particularly, as the polycondensable monomer, polyvalent carboxylic acid, polyol, and ester compounds thereof (oligomer and/or prepolymer) are preferably used, and through a direct ester reaction or a transesterification reaction, a polyester resin may be obtained. In this case, a polyester resin to be polymerized may have any form of an amorphous polyester resin, a non-crystalline polyester resin, a crystalline polyester resin and the like, or a mixed form thereof.

In this exemplary embodiment, the polycondensation resin may be obtained by polycondensation of at least one selected from the group consisting of a polycondensable monomer, and an oligomer and a prepolymer thereof. Among them, a polycondensable monomer is preferably used.

The polyvalent carboxylic acid is a compound containing two or more carboxylic groups in one molecule. Of polyvalent carboxylic acids, the dicarboxylic acid is a compound containing two carboxylic groups in one molecule, and examples thereof include oxalic acid, succinic acid, glutaric acid, maleic acid, adipic acid, β-methyl adipic acid, azelaic acid, sebacic acid, nonanedicarboxylic acid, decanedicarboxylic acid, undecanedicarboxylic acid, dodecanedicarboxylic acid, fumaric acid, citraconic acid, diglycol acid, cyclohexane-3,5-diene-1,2-carboxylic acid, hexahydroterephthalic acid, malonic acid, pimelic acid, suberic acid, phthalic acid, isophthalic acid, terephthalic acid, tetrachlorophthalic acid, chlorophthalic acid, nitrophthalic acid, p-carboxyphenyl acetic acid, p-phenylenediacetic acid, m-phenylenediacetic acid, o-phenylenediacetic acid, diphenylacetic acid, diphenyl-p,p'-dicarboxylic acid, naphthalene-1,4-dicarboxylic acid, naphthalene-1,5-dicarboxylic acid, naphthalene-2,6-dicarboxylic acid, anthracenedicarboxylic acid, cyclohexanedicarboxylic acid, and the like.

Examples of polyvalent carboxylic acids other than the dicarboxylic acid include trimellitic acid, trimeric acid, pyromellitic acid, naphthalenetricarboxylic acid, naphthalenetetracarboxylic acid, pyrenetricarboxylic acid, pyrenetetracarboxylic acid, itaconic acid, glutaconic acid, n-dodecyl succinic acid, n-dodecenyl succinic acid, isododecyl succinic acid, isododecenyl succinic acid, n-octyl succinic acid, n-octenyl succinic acid, lower esters thereof, and the like, and so do cases of acid halides and acid anhydrides.

These may be used singly or in combination of two or more kinds.

The lower ester is an ester in which the alkoxy portion of the ester has carbon atoms of 1 to 8. Specific examples thereof include methyl ester, ethyl ester, n-propyl ester, isopropyl ester, n-butyl ester, isobutyl ester, and the like.

The polyol is a compound containing two or more hydroxyl groups in one molecule. Of polyols, the diol is a compound containing two hydroxyl groups in one molecule, and specific examples thereof include ethylene glycol, diethylene glycol, triethylene glycol, 1,2-propylene glycol, 1,3-propylene glycol, 1,4-butanediol, 1,5-pentanediol, 1,6-hexanediol, 1,7-heptanediol, 1,8-octanediol, 1,9-nonanediol, 1,10-decanediol, 1,11-undecanedoil, 1,12-dodecanediol, 1,13-tridecanediol, 1,14-tetradecanediol, 1,18-octadecanediol, 1,14-eicosanedecanediol, dipropylene glycol, polyethylene glycol, polypropylene glycol, polytetramethylene ether glycol, 1,4-cyclohexanediol, 1,4-cyclohexanedimethanol, 1,4-butenediol, neopentylglycol, polytetramethylene glycol, hydrogenated bisphenol A, bisphenol A, bisphenol F, bisphenol S, alkylene oxide adducts of the bisphenols (ethylene oxide, propylene oxide, butylene oxide and the like), and the like. Among them, alkylene glycol having carbon atoms of 2 to 12 and alkylene oxide adducts of the bisphenols are preferably used, and alkylene oxide adducts of the bisphenols and combinations of alkylene oxide adducts of the bisphenols and alkylene glycol having carbon atoms of 2 to 12 are particularly preferably used.

In addition, examples of a material for higher water dispersibility include 2,2-dimethylol propionic acid, 2,2-dimethylol butanoic acid, 2,2-dimethylol valeric acid and the like.

Examples of tri- or higher-valent alcohols include glycerin, trimethylolethane, trimethylolpropan, pentaerythritol, hexamethylolmelamime, hexaethylolmelamine, tetramethylolbenzoguanamine, tetraethylolbenzoguanamine, sorbitol, trisphenol PA, phenol novolac, cresol novolac, alkylene oxide adducts of the tri- or higher-valent polyphenols, and the like. These may be used singly or in combination of two or more kinds.

In addition, amorphous and crystalline resins may be easily obtained by combining the polycondensable monomers.

Examples of a crystalline polyester resin that is used as a binder resin include polyester that is obtained by reacting 1,9-nonanediol and 1,10-decanedicarboxylic acid, or reacting cyclohexanediol and adipic acid, polyester that is obtained by reacting 1,6-hexanediol and sebacic acid, polyester that is obtained by reacting ethylene glycol and succinic acid, polyester that is obtained by reacting ethylene glycol and sebacic acid, and polyester that is obtained by reacting 1,4-butanediol and succinic acid. Among them, polyester that is obtained by reacting 1,9-nonanediol and 1,10-decanedicarboxylic acid, polyester that is obtained by 1,6-hexanediol and sebacic acid, and the like are particularly preferably used, but the invention is not limited thereto.

In addition, hydroxycarboxylic acid may also be used. Specific examples of the hydroxycarboxylic acid include hydroxyheptanoic acid, hydroxyoctanoic acid, hydroxydecanoic acid, hydroxyundecanoic acid, malic acid, acidum tartaricum, mucic acid, citric acid, and the like.

In addition, examples of polyamine include ethylenediamine, diethylenediamine, 1,2-propanediamine, 1,3-propanediamine, 1,4-butanediamine, 1,4-butenediamine, 2,2-dimethyl-1,3-butanediamine, 1,5-pentanediamine, 1,6-hexanediamine, 1,4-cyclohexanediamine, 1,4-cyclohexanebis(methylamine), and the like.

In addition, the weight average molecular weight of the polycondensation resin that is obtained by polycondensation of a polycondensable monomer is preferably from 1,500 to 40,000, and more preferably from 3,000 to 30,000. Since the binder resin has a good cohesive force and an excellent hot offset property, it is desirable that the weight average molecular weight be 1,500 or greater, and since an excellent hot offset property is obtained and an excellent minimum fixing temperature is shown, it is desirable that the weight average molecular weight be 40,000 or less. In addition, partial branching, cross-linking and the like may be included by selection in carboxylic acid valence of the monomer and alcohol valence.

In addition, the acid value of the obtained polyester resin is preferably from 1 mg·KOH/g to 50 mg·KOH/g. A first reason is that the toner particle size and the distribution in an aqueous medium are required to be controlled for practical use as a high-image quality toner, and when the acid value is 1 mg·KOH/g or greater, a sufficient particle size and distribution may be achieved in the granulation process. Furthermore, a sufficient electrification property may be obtained when the polyester resin is used in the toner. When the acid value of the polycondensed polyester is 50 mg·KOH/g or less, a sufficient molecular weight for obtaining image quality strength for the toner may be obtained in the polycondensation. In addition, dependence of the electrification property of the toner on environment at a high humidity is also reduced and excellent image quality reliability is obtained.

When an amorphous polyester resin is used, the glass transition temperature Tg of the amorphous polyester resin is preferably from 50° C. to 80° C., and more preferably from 50° C. to 65° C. When Tg is 50° C. or higher, the binder resin itself in a high-temperature region has an excellent cohesive force, the hot offset property becomes excellent in the fixing. When Tg is 80° C. or lower, melting is sufficiently carried out and the minimum fixing temperature does not easily rise.

The glass transition temperature of the binder resin is a value measured by a method (DSC method) specified in ASTM D3418-82.

Examples of the addition polymerizable monomer to be used in the preparation of an addition polymerization-type resin include a cationic polymerizable monomer and a radical polymerizable monomer, and a radical polymerizable monomer is preferably used.

Examples of the radical polymerizable monomer include styrene-based monomers, unsaturated carboxylic acids, (meth)acrylates ("(meth)acrylates" means acrylate and methacrylate, and has the same usage below), N-vinyl compounds, vinyl esters, halogenated vinyl compounds, N-substituted unsaturated amides, conjugated dienes, multifunctional vinyl compounds, multifunctional (meth)acrylates, and the like. Among them, N-substituted unsaturated amides, conjugated dienes, multifunctional vinyl compounds and multifunctional (meth)acrylates and the like may impose a cross-linking reaction to the generated polymer. These may be used singly or in combination.

Examples of the addition polymerizable monomer that may be used in this exemplary embodiment include a radical polymerizable monomer, a cationic polymerizable monomer and an anionic polymerizable monomer, and a radical polymerizable monomer is preferably used.

As a radical polymerizable monomer, a compound having an ethylenic unsaturated bond is preferably used, and an aromatic ethylenic unsaturated compound (hereinafter, may be referred to as "vinyl aromatic compound"), carboxylic acid (unsaturated carboxylic acid) having an ethylenic unsaturated bond, a derivative of unsaturated carboxylic acid, such as ester, aldehide, nitrile or amide, a N-vinyl compound, vinyl esters, a halogenated vinyl compound, a N-substituted unsaturated amide, conjugated diene, a multifunctional vinyl compound, or multifunctional (meth)acrylate is more preferably used.

Specific examples thereof include unsubstituted vinyl aromatics such as styrene and p-vinylpyridine, vinyl aromatics such as α-substituted styrenes such as α-methylstyrene and α-ethylstyrene, aromatic nucleus-substituted styrenes such as m-methylstyrene, p-methylstyrene and 2,5-dimethylstyrene, and aromatic-nucleus halogen-substituted styrenes such as p-chlorostyrene, p-bromostyrene and dibromostyrene, unsaturated carboxylic acids such as (meth)acrylic acid ("(meth)acryl" means acryl and methacryl, and has the same usage below), crotonic acid, maleic acid, fumaric acid, citraconic acid and itaconic acid, unsaturated carboxylic acid esters such as methyl(meth)acrylate, ethyl(meth)acrylate, propyl(meth)acrylate, butyl(meth)acrylate, pentyl(meth)acrylate, hexyl(meth)acrylate, 2-ethylhexyl(meth)acrylate, glysidyl(meth)acrylate and benzyl(meth)acrylate, unsaturated carboxylic acid derivatives such as (meth)acrylic aldehide, (meth)acrylonitrile and (meth)acrylamide, N-vinyl compounds such as N-vinylpyridine and N-vinylpyrrolidone, vinyl esters such as vinyl formate, vinyl acetate and vinyl propionate, halogenated vinyl compounds such as vinyl chloride, vinyl bromide and vinylidene chloride, N-substituted unsaturated amides such as N-methylolacrylamide, N-ethylolacrylamide, N-propanolacrylamide, N-methylolmaleinamide acid, N-methylolmaleinamide acid ester, N-methylolmaleimide and N-ethylolmaleimide, conjugated dienes such as butadiene and isoprene, multifunctional vinyl compounds such as divinylbenzene, divinylnaphthalene, divinylcyclohexane, multifunctional acrylates such as ethylene glycol (meth)acrylate, diethylene glycol di(meth)acrylate, propylene glycol di(meth)acrylate, tetramethylene glycol di(meth) acrylate, neopentyl glycol di(meth)acrylate, hexamethylene glycol di(meth)acrylate, trimethylol propan di(meth)acrylate, trimethylol propan tri(meth)acrylate, glycerol di(meth) acrylate, glycerol tri(meth)acrylate, pentaerythritol di(meth) acrylate, pentaerythritol tri(meth)acrylate, pentaerythritol tetra(meth)acrylate, dipentaerythritol di(meth)acrylate, dipentaerythritol tri(meth)acrylate, dipentaerythritol tetra (meth)acrylate, dipentaerythritol penta(meth)acrylate, dipentaerythritol hexa(meth)acrylate, sorbitol tri(meth)acrylate, sorbitol tetra(meth)acrylate, sorbitol penta(meth)acrylate and sorbitol hexa(meth)acrylate, and the like. In addition, sulfonic acid and phosphoric acid having an ethylenic unsaturated bond, and derivatives thereof may also be used. Among them, N-substituted unsaturated amides, conjugated dienes, multifunctional vinyl compounds, multifunctional acrylates and the like may impose a cross-linking reaction to the generated polymer. The addition polymerizable monomers may be used singly or in combination of two or more kinds.

In addition, the content of the binder resin in the toner according to this exemplary embodiment is preferably from 10% by weight to 90% by weight with respect to the total weight of the toner, more preferably from 30% by weight to 85% by weight, and even more preferably from 50% by weight to 80% by weight.

<Colorant>

In this exemplary embodiment, the toner contains a colorant.

A known material may be used as a colorant and arbitrarily selected from the viewpoint of a hue angle, a chroma, brightness, weather resistance, OHP permeability and dispersibility in the toner.

Specific examples thereof include various pigments such as Watchung Red, Permanent Red, Brilliant Carmine 3B, Brilliant Carmine 6B, Du Pont oil red, Pyrazolone Red, Lithol Red, Rhodamine B Lake, Lake Red C and Rose Bengale, various dyes such as acridine-based, xanthene-based, azo-based, benzoquinone-based, azine-based, anthraquinone-based, thioindigo-based, dioxazine-based, thiazine-based, azomethine-based, indigo-based, phthalocyanine-based, aniline black-based, polymethine-based, triphenylmethane-based, diphenylmethane-based, thiazine-based, thiazole-based, and the like.

In addition, specifically, it is desirable that as the colorant, carbon black, nigrosine dye (C.I. No. 50415B), aniline blue (C.I. No. 50405), chalcoil blue (C.I. No. azoic Blue 3), chrome yellow (C.I. No. 14090), ultramarine blue (C.I. No. 77103), Du Pont oil red (C.I. No. 26105), quinoline yellow (C.I. No. 47005), methylene blue chloride (C.I. No. 52015), phthalocyanine blue (C.I. No. 74160), malachite green oxalate (C.I. No. 42000), lampblack (C.I. No. 77266), rose-bengal (C.I. No. 45435), mixtures thereof, and the like be used.

In this exemplary embodiment, it is desirable that a magenta colorant be contained as a colorant.

The colorant amount used is preferably from 0.1 part by weight to 20 parts by weight with respect to 100 parts by weight of the toner, and more preferably from 0.5 part by weight to 10 parts by weight. In addition, these pigments, dyes and the like may be used singly or in combination of two or more kinds as a colorant.

As a method of dispersing a colorant, an arbitrary method, for example, a general dispersion method using a rotational shear-type homogenizer, a ball mill having a medium, a sand mill or a dyno mill may be used, and there is no limitation thereon. In addition, these colorant particles may be added to the mixture solvent together with other particle components at a time, or in multiple divided stages.

<Release Agent>

It is desirable that the electrostatic latent image developing toner according to this exemplary embodiment contains a release agent.

It is desirable that ester wax, polyethylene, polypropylene, or a copolymer of polyethylene and polypropylene be used as the release agent, and specific examples thereof include waxes such as polyglycerin wax, microcrystalline wax, paraffin wax, carnauba wax, Sasol wax, montanic acid ester wax and deoxidized carnauba wax, unsaturated fatty acids such as palmitic acid, stearic acid, montanic acid, brassidic acid, eleostearic acid and parinaric acid, saturated alcohols such as stearyl alcohol, aralkyl alcohol, behenyl alcohol, carnaubyl alcohol, ceryl alcohol, melissyl alcohol and long-chain alkyl alcohols having a long-chain alkyl group, polyols such as sorbitol, fatty acid amides such as linoleic acid amide, oleic acid amide and lauric acid amide, saturated fatty acid bisamides such as methylenebisstearic acid amide, ethylenebiscapric acid amide, ethylenebislauric acid amide and hexamethylenebisstearic acid amide, unsaturated fatty acid amides such as ethylenebisoleic acid amide, hexamethylenebisoleic acid amid; N,N'-dioleyladipic acid amide and N,N'-dioleylcebasic acid amide, aromatic bisamides such as m-xylenebisstearic acid amide and N,N'-distearylisophthalic acid amide, fatty acid metal salts (generally so-called metal soaps) such as calcium stearate, calcium laurate, zinc stearate and magnesium stearate, waxes grafted to aliphatic hydrocarbon-based wax using a vinyl-based monomer such as styrene and acrylic acid, partially esterified products of a fatty acid and a polyol such as behenic acid monoglyceride, methyl ester compounds having a hydroxyl group that is obtained by hydrogenating vegetable oil, and the like.

The release agent may be used singly or in combination of two or more kinds. The release agent is preferably contained in the range of from 1% by weight to 20% by weight with respect to 100% by weight of the binder resin, and more preferably from 3% by weight to 15% by weight. When the content is in the above range, excellent fixing and image quality characteristics may be balanced.

<Other Components>

If necessary, various components, such as an internal additive, a charge-controlling agent, an inorganic powder (inorganic particles) and organic particles, other than the above-described components may be added to the toner.

Examples of the internal additive include magnetic materials, such as metals such as ferrite, magnetite, reduced iron, cobalt, nickel and manganese, alloys and compounds containing the metals. When the toner contains the magnetic material and the like and is used as a magnetic toner, the average particle size of the ferromagnetic materials is preferably 2 μm or less, and more preferably from about 0.1 μm to about 0.5 μm. The amount contained in the toner is preferably from 20 parts by weight to 200 parts by weight with respect to 100 parts by weight of the resin component, and particularly preferably from 40 parts by weight to 150 parts by weight with respect to 100 parts by weight of the resin component. In addition, regarding the magnetic characteristics when 10 kOe is applied, it is desirable that the coercive force (Hc) be from 20 Oe to 300 Oe, the saturated magnetization (σs) be from 50 emu/g to 200 emu/g, and the remnant magnetization (σr) be from 2 emu/g to 20 emu/g.

Examples of the charge-controlling agent include tetrafluorine-based surfactants, salicylic acid metal complexes, metal complex dyes such as an azo-based metal compound, polymer acids such as a polymer containing maleic acid as a monomer component, quaternary ammonium salts, and azine-based dyes such as nigrosine.

For the purpose of viscoelasticity adjustment, the toner may contain an inorganic powder. Examples of the inorganic powder include all of inorganic particles that are normally used as an external additive for a toner surface, to be described later in detail, such as silica, alumina, titania, calcium carbonate, magnesium carbonate, calcium phosphate, and cerium oxide.

<External Additive>

If necessary, an external additive may be externally added to the surface of toner. Examples of the external additive that is externally added to the surface include inorganic and organic particles, and specifically, the following examples and the external additive that is used in a toner manufacturing method to be described later are also included.

Examples of the inorganic particles include silica, alumina, titanium oxide, barium titanate, magnesium titanate, calcium titanate, strontium titanate, zinc oxide, silica sand, clay, mica, wollastonite, diatomaceous earth, cerium chloride, red iron oxide, chromium oxide, cerium oxide, antimony trioxide, magnesium oxide, zirconium oxide, silicon carbide, silicon nitride, and the like.

Generally, the inorganic particles are used for the purpose of improving fluidity. It is desirable that the primary particle size of the inorganic particles be in the range of from 1 nm to 200 nm and the amount added be in the range of from 0.01 part by weight to 20 parts by weight with respect to 100 parts by weight of the toner.

Generally, the organic particles are used for the purpose of improving cleanability and transferability, and specific examples thereof include fluorine-based resin powders such as polyvinylidene fluoride and polytetrafluoroethylene, fatty acid metal salts such as zinc stearate and calcium stearate, polystyrene, polymethylmethacrylate, and the like.

Among the above-described external additives, inorganic oxides such as titanic and silica are preferably used from the viewpoint of improvement in fluidity and charging characteristics. Particularly, in the case in which there is a difference in affinity of inorganic oxides for toner constituent materials (for example, when there is a great difference between the affinity for the release agent and the affinity for the binder resin), when the amount of the release agent or the crystalline resin exposed to the toner surface is large, the external additive may be easily unevenly distributed on the toner surface. However, in the case of the toner according to this exemplary embodiment, as described above, the exposure of the release agent and the crystalline resin to the toner surface is suppressed, and thus the above-described uneven distribution of the external additive is also suppressed.

Specific examples of the inorganic oxides (inorganic oxides with a difference therebetween in affinity for toner constituent materials) that particularly easily cause the above-described uneven distribution of the external additive include untreated titania or silica, silane coupling agent- or silicon oil-treated titania or silica, and the like. Particularly, an inorganic oxide having a primary particle size exceeding 30 nm is easily unevenly distributed.

It is desirable that the amount of each kind of the inorganic oxides externally added be 0.1 part by weight to 5 parts by weight with respect to 100 parts by weight of the toner particles before external addition. When the amount externally added is less than 0.1 part by weight, the function of improving the fluidity and electrification property of the external additive may not be sufficiently apparent. In addition, when the amount externally added is greater than 5 parts by weight, and particularly, the external additive is titania, the electrification property may not be sufficiently given.

<Toner Properties>

The volume average particle size ($D_{50v}$) of the toner according to this exemplary embodiment is preferably from 2 μm to 20 μm, more preferably from 3 μm to 15 μm, and even more preferably from 3 μm to 12 μm.

In addition, the volume average particle size ($D_{50v}$) of the toner base particles of the toner according to this exemplary embodiment is preferably from 2 μm to 20 μm, more preferably from 3 μm to 15 μm, and even more preferably from 3 μm to 12 μm.

It is desirable that the particle size distribution of the toner be narrow. More specifically, the value (GSDp) of the square root of the ratio of the 84% diameter ($D_{84p}$) to the 16% diameter ($D_{16p}$) converted from the smallest number diameter side of the toner, that is, GSDp that is expressed by the following formula is preferably 1.40 or less, more preferably 1.31 or less, and particularly preferably 1.27 or less. In addition, GSDp is even more preferably 1.15 or greater.

$$\mathrm{GSDp}=\{(D_{84p})/(D_{16p})\}^{0.5}$$

When both of the volume average particle size and GSDp are in the above ranges, excessively small particles do not present, and thus a reduction in developability due to an excessive charge amount of the small particle-size toner may be suppressed.

In the measurement of the average particle size of particles of the toner, Coulter Multisizer II (manufactured by Beckman Coulter, Inc.) may be used. In this case, the measurement may be performed using an optimum aperture depending on the particle size level of the particles. The measured particle size of the particles is expressed by the volume average particle size.

When the particle size of the particles is 5 μm or less, the measurement may be performed using a laser diffraction/scattering particle size distribution measuring device (LA-700, manufactured by Horiba, Ltd.).

Furthermore, when the particle size is a nanometer-order size, the measurement may be performed using a BET specific surface measuring device (Flow Sorb II 2300, manufactured by Shimadzu Corporation).

In this exemplary embodiment, a shape factor SF1 of the toner is preferably in the range of from 110 to 145, and more preferably from 120 to 140.

The shape factor SF1 is a shape factor showing the degree of unevenness of the particle surface, and is calculated using the following formula.

$$SF1 = \frac{(ML)^2}{A} \times \frac{\pi}{4} \times 100 \qquad \text{[Formula 1]}$$

In the formula, ML represents the maximum length of the particle, and A represents a projected area of the particle.

As a specific method of measuring SF1, for example, first, an optical microscopic image of the toner sprayed on a glass slide is scanned to an image analyzer through a video camera, SF1 of 50 toner particles is calculated, and an average value thereof is obtained.

<Toner Preparation Method>

The toner manufacturing method according to this exemplary embodiment is not particularly limited. Toner particles are prepared by a dry method such as a known kneading pulverization method or a wet method such as an emulsion aggregation method or a suspension polymerization method, and if necessary, an external additive is externally added to the toner particles. Among these methods, a kneading pulverization method is preferably used.

The kneading pulverization method is a method including: kneading a toner forming material containing a colorant and a binder resin to obtain a kneaded material; and pulverizing the kneaded material to prepare toner particles. When the toner particles are prepared by the kneading pulverization method to obtain the toner, the complex powder is dispersed well, and the high color retentivity is improved.

More specifically, the kneading pulverization method is divided into a kneading process of kneading a toner forming material containing a colorant and a binder resin and a pulverization process of pulverizing the kneaded material. If necessary, the kneading pulverization method may have other processes such as a cooling process of cooling the kneaded material formed by the kneading process, and a classification process of classifying the kneaded material pulverized by the pulverization process.

The respective processes will be described in detail.

[Kneading Process]

The kneading process is a process of kneading a toner forming material containing a colorant and a binder resin.

In the kneading process, it is desirable that from 0.5 part by weight to 5 parts by weight of an aqueous medium (for example, water such as distilled water or ion exchange water, alcohols or the like) be added with respect to 100 parts by weight of a toner forming material.

Examples of a kneader to be used in the kneading process include a one-axis extruder, a two-axis extruder, and the like. Hereinafter, as an example of the kneader, a kneader having a sending screw portion and two kneading portions will be described using a diagram, but is not limited thereto.

FIG. 1 is a diagram illustrating a state of a screw of an example of the screw extruder that is used in the kneading process in the toner manufacturing method according to this exemplary embodiment.

A screw extruder 11 is constituted by a barrel 12 provided with a screw (not shown), an injection port 14 through which a toner forming material that is a raw material of the toner is injected to the barrel 12, a liquid addition port 16 for adding an aqueous medium to the toner forming material in the barrel 12, and a discharge port 18 through which the kneaded material formed by kneading the toner forming material in the barrel 12 is discharged.

The barrel 12 is divided into a sending screw portion SA that transports the toner forming material injected from the injection port 14 to a kneading portion NA, the kneading portion NA for melting and kneading the toner forming material by a first kneading process, a sending screw portion SB that transports the toner forming material melted and kneaded in the kneading portion NA to a kneading portion NE, the kneading portion NB that melts and kneads the toner forming material by a second kneading process to form the kneaded material, and a sending screw portion SC that transports the formed kneaded material to the discharge port 18, closest to the injection part 14 in this order.

In addition, in the barrel 12, a different temperature controller (not shown) is provided for each block. That is, the temperatures of blocks 12A to 12J may be controlled to be different from each other. FIG. 1 shows a state in which the temperatures of the blocks 12A and 12B are controlled to t0° C., the temperatures of the blocks 12C to 12E are controlled to t1° C., and the temperatures of the blocks 12F to 12J are controlled to t2° C. Therefore, the toner forming material in the kneading portion NA is heated to t1° C., and the toner forming material in the kneading portion NB is heated to t2° C.

When a toner forming material containing a binder resin, a colorant, and if necessary, a release agent and the like is supplied to the barrel 12 from the injection port 14, the toner forming material is sent to the kneading portion NA by the sending screw portion SA. At this time, since the temperature of the block 12C is set to t1° C., the toner forming material melted by heating is fed to the kneading portion NA. In addition, since the temperatures of the blocks 12D and 12E are also set to t1° C., the toner forming material is melted and kneaded at a temperature of t1° C. in the kneading portion NA. The binder resin and the release agent are melted in the kneading portion NA and shorn by the screw.

Next, the toner forming material kneaded in the kneading portion NA is sent to the kneading portion NB by the sending screw portion SB.

In the sending screw portion SB, an aqueous medium is added to the toner forming material by injecting the aqueous medium to the barrel 12 from the liquid addition port 16. In addition, in FIG. 1, the aqueous medium is injected in the sending screw portion SB, but the invention is not limited thereto. The aqueous medium may be injected in the kneading portion NB, or may be injected in both of the sending screw portion SB and the kneading portion NB. That is, the position at which the aqueous medium is injected and the number of injection positions are selected as necessary.

As described above, due to the injection of the aqueous medium to the barrel 12 from the liquid addition port 16, the toner forming material in the barrel 12 and the aqueous medium are mixed, and the toner forming material is cooled by evaporative latent heat of the aqueous medium, whereby the temperature of the toner forming material is properly maintained.

Finally, the kneaded material formed by melting and kneading by the kneading portion NB is transported to the discharge port 18 by the sending screw portion SC and is discharged from the discharge port 18.

As described above, the kneading process using the screw extruder 11 shown in FIG. 1 is performed.

[Cooling Process]

The cooling process is a process of cooling the kneaded material formed in the kneading process, and in the cooling process, it is desirable that the kneaded material be cooled up to 40° C. or lower from the temperature of the kneaded material upon the end of the kneading process at an average temperature decrease rate of 4° C./sec or higher. When the cooling rate of the kneaded material is low, the mixture (mixture of a colorant and an internal additive such as a release agent to be internally added into toner particles as necessary) finely dispersed in the binder resin in the kneading process may be recrystallized and the dispersion diameter may increase. Since the dispersion state immediately after the end of the kneading process is maintained as is, it is desirable the kneaded material be rapidly cooled at the average temperature decrease rate. The average temperature decrease rate is an average value of the rate at which the temperature is decreased up to 40° C. from the temperature of the kneaded material upon the end of the kneading process (for example, t2° C. when the screw extruder 11 of FIG. 1 is used).

Specific examples of a cooling method in the cooling process include a method using a mill roll in which cold water or brine is circulated, an insertion-type cooling belt and the like. When the cooling is performed using the above-described method, the cooling rate is determined by the speed of the mill roll, the flow rate of the brine, the supply amount of the kneaded material, the slab thickness at the time of rolling of the kneaded material, and the like. It is desirable that the slab thickness be from 1 to 3 mm.

[Pulverization Process]

The kneaded material cooled by the cooling process is pulverized by the pulverization process to form toner particles. In the pulverization process, for example, a mechanical pulverizer, a jet pulverizer or the like is used.

[Classification Process]

If necessary, the toner particles obtained by the pulverization process may be classified by a classification process in order to obtain toner particles having a volume average particle size in the target range. In the classification process, a centrifugal classifier, an inertia-type classifier or the like that has been used in the past is used, and fine particles (toner particles having a particle size smaller than the target range) and coarse particles (toner particles having a particle size larger than the target range) are removed.

[External Addition Process]

For the purpose of adjusting the charging, giving fluidity, giving charge exchangeability, and the like, the above-described inorganic particles typified by particular silica, titania and aluminum oxide may be added and adhered to the obtained toner particles. This is performed by, for example, a V-shaped blender, a Henschel mixer, a Loedige mixer or the like, and the adhesion is performed in stages.

[Sieving Process]

If necessary, a sieving process may be provided after the above-described external addition process. Specifically, as a sieving process, for example, a gyro shifter, a vibration sieving machine, a wind classifier or the like is used. By performing the sieving, coarse particles of the external additive and the like are removed, and thus the generation of stripes and trickling down contamination are suppressed.

(Electrostatic Latent Image Developer)

An electrostatic latent image developer according to this exemplary embodiment (hereinafter, may be referred to as "developer") is not particularly limited if it contains the above-described toner according to this exemplary embodiment. The electrostatic latent image developer may be a single-component developer using a toner alone, or a two-component developer containing a toner and a carrier. When the electrostatic latent image developer is a single-component developer, it may be a toner containing magnetic metallic particles or a nonmagnetic single-component toner not containing magnetic metallic particles.

The carrier is not particularly limited if it is a known carrier, and an iron powder-based carrier, a ferrite-based carrier, a surface-coated ferrite carrier or the like is used. In addition, respective surface additional powders may be used after being subjected to a desired surface treatment.

Specific examples of the carrier include carriers coated with the following resins. Examples of nucleus particles of the carrier include a normal iron powder, ferrite, a granulated magnetite, and the like, and it is desirable that the volume average particle size thereof is from 30 μm to 200 μm.

In addition, examples of the coating resin of the resin-coated carrier include homopolymers or copolymers made of two or more kinds of monomers of styrenes such as styrene, parachlorostyrene and α-methylstyrene; α-methylene fatty acid monocarboxylic acids such as methyl acrylate, ethyl acrylate, n-propyl acrylate, lauryl acrylate, 2-ethylhexyl acrylate, methyl methacrylate, n-propyl methacrylate, lauryl methacrylate and 2-ethylhexyl methacrylate; nitrogen-containing acryls such as dimethylaminoethyl methacrylate; vinyl nitriles such as acrylonitrile and methacrylonitrile; vinyl pyridines such as 2-vinylpyridine and 4-vinylpyridine; vinyl ethers such as vinyl methyl ether and vinyl isobutyl ether; vinyl ketones such as vinyl methyl ketone, vinyl ethyl ketone and vinyl isopropenyl ketone; olefins such as ethylene and propylene; fluorine-containing vinyl-based monomers such as vinylidene fluoride, tetrafluoroethylene and hexafluoroethylene, as well as silicone resins including methyl silicone and methylphenyl silicone, polyesters including bisphenol and glycol, epoxy resins, polyurethane resins, polyamide resins, cellulose resins, polyether resins, and polycarbonate resins. These resins may be used singly or in combination of two or more kinds. The coating amount of the coating resin is preferably in the range of from about 0.1 part by weight to about 10 parts by weight with respect to 100 parts by weight of the nucleus particles, and more preferably in the range of from about 0.5 part by weight to about 3.0 parts by weight.

The carrier is manufactured using, for example, a heating kneader, a heating Henschel mixer, or a UM mixer. Depending on the amount of the coating resin, a heating fluidized bed, a heating kiln or the like is used.

Since excellent resistance controllability is obtained even when a thick coated layer is formed, and thus excellent image quality and image quality maintainability are obtained, it is desirable that as the carrier, a carrier is used that is formed by coating ferrite particles as a nuclear body with a resin in which, for example, carbon black as an electroconductive agent and/or melamine beads as a charge-controlling agent are dispersed in methyl acrylate or ethyl acrylate and styrene.

The mixing ratio of the toner and the carrier in the developer is not particularly limited and is selected depending on the purpose.

(Image Forming Apparatus)

Next, an image forming apparatus using the electrostatic latent image developing toner according to this exemplary embodiment will be described.

An image forming apparatus according to this exemplary embodiment has an image holding member, a charging unit that charges the image holding member, a latent image forming unit that forms an electrostatic latent image on a surface of the image holding member, a developing unit that develops the electrostatic latent image on the surface of the image holding member by a toner to form a toner image, and a transfer unit that transfers the toner image onto a surface of a transfer medium, and the toner is the electrostatic latent image developing toner according to this exemplary embodiment. In addition, the image forming apparatus may have a fixing unit that fixes the toner image transferred onto the surface of the transfer medium and a cleaning unit (toner removing unit) that scrubs the image holding member with a cleaning member to remove a residual component left after the transfer.

In the image forming apparatus, for example, a portion including the developing unit may be formed into a cartridge structure (process cartridge) that is detachably mounted on an image forming apparatus body. As the process cartridge, a process cartridge according to this exemplary embodiment, that is provided with at least a developer holding member and accommodates a developer for electrostatic latent image development according to this exemplary embodiment, is appropriately used.

Hereinafter, an example of the image forming apparatus according to this exemplary embodiment will be described. However, the invention is not limited thereto. Major portions shown in the drawing will be described, and descriptions of other portions will be omitted.

Figure 2:
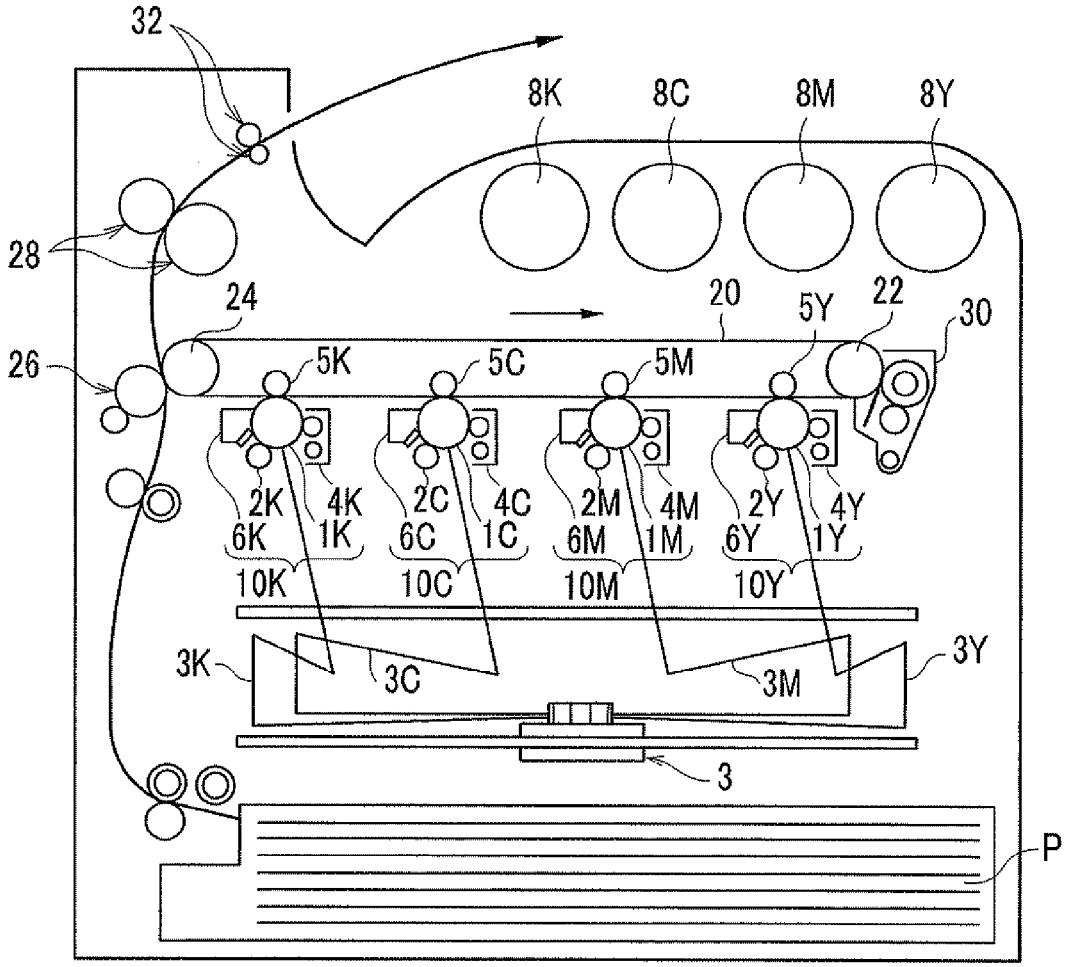
FIG. 2 is a diagram schematically showing the configuration of an example of an image forming apparatus that is appropriately used in the exemplary embodiment.

FIG. 2 is a diagram schematically showing the configuration of a 4-drum tandem full-color image forming apparatus. The image forming apparatus shown in FIG. 2 is provided with first to fourth electrophotographic image forming units 10Y, 10M, 10C and 10K (image forming sections) that output images of the respective colors of yellow (Y), magenta (M), cyan (C) and black (K) based on color-separated image data. The image forming units (hereinafter, simply referred to as "unit") 10Y, 10M, 10C and 10K are arranged in a horizontal direction at a distance from each other. The units 10Y, 10M, 10C and 10K each may be a process cartridge that is detachably mounted on the image forming apparatus body.

An intermediate transfer belt 20 as an intermediate transfer medium is disposed above the units 10Y, 10M, 10C, and 10K in the drawing to extend via the units. The intermediate transfer belt 20 is wound on a driving roller 22 and a support roller 24 contacting the inner surface of the intermediate transfer belt 20, which are separated from each other on the left and right sides in the drawing, and travels in the direction toward the fourth unit 10K from the first unit 10Y. The support roller 24 is impelled in the direction in which it departs from the driving roller 22 by a spring or the like (not shown), and thus a tension is given to the intermediate transfer belt 20 wound on both of the rollers. In addition, an intermediate transfer medium cleaning device 30 opposed to the driving roller 22 is provided in a surface of the intermediate transfer belt 20 on the image holding member side.

Developing devices (developing units) 4Y, 4M, 4C and 4K of the units 10Y, 10M, 10C and 10K are supplied with four color toners of yellow, magenta, cyan, and black accommodated in toner cartridges 8Y, 8M, 8C and 8K, respectively.

The above-described first to fourth units 10Y, 10M, 10C, and 10K have the same configuration, and thus only the first unit 10Y that is used for forming a yellow image and is disposed on the upstream side in the traveling direction of the intermediate transfer belt will be representatively described. The same portions as in the first unit 10Y will be denoted by the reference numerals having magenta (M), cyan (C), and black (K) added instead of yellow (Y), and descriptions of the second to fourth units 10M, 10C, and 10K will be omitted.

The first unit 10Y has a photoreceptor 1Y serving as an image holding member. Around the photoreceptor 1Y, a charging roller 2Y that charges a surface of the photoreceptor 1Y, an exposure device 3 that exposes the charged surface with a laser beam 3Y based on a color-separated image signal to form an electrostatic latent image, a developing device (developing unit) 4Y that supplies a charged toner to the electrostatic latent image to develop the electrostatic latent image, a primary transfer roller (primary transfer unit) 5Y that transfers the developed toner image onto the intermediate transfer belt 20, and a photoreceptor cleaning device (cleaning unit) 6Y that removes the toner remaining on the surface of the photoreceptor 1Y after the primary transfer, are arranged in sequence.

The primary transfer roller 5Y is disposed inside the intermediate transfer belt 20 and is provided at a position opposed to the photoreceptor 1Y. Bias supplies (not shown) that apply a primary transfer bias are connected to the primary transfer rollers 5Y, 5M, 5C, and 5K, respectively. The bias supplies change the transfer bias that is applied to the respective primary transfer rollers under the control of a controller (not shown).

Hereinafter, the operation of forming a yellow image in the first unit 10Y will be described. First, before the operation, the surface of the photoreceptor 1Y is charged to a potential of from about −600 V to about −800 V by the charging roller 2Y.

The photoreceptor 1Y is formed by stacking a photosensitive layer on a conductive base (volume resistivity at 20° C.: $1\times10^{-6}$ Ωcm or less). This photosensitive layer typically has high resistance (resistance corresponding to the resistance of a general resin), but has a property that, when the laser beam 3Y is applied thereto, the specific resistance of a portion irradiated with the laser beam changes. Accordingly, the laser beam 3Y is output to the surface of the charged photoreceptor 1Y via the exposure device 3 in accordance with image data for yellow sent from the controller (not shown). The laser beam 3Y is applied to the photosensitive layer on the surface of the photoreceptor 1Y, whereby an electrostatic latent image of a yellow print pattern is formed on the surface of the photoreceptor 1Y.

The electrostatic latent image is an image that is formed on the surface of the photoreceptor 1Y by the charging, and is a so-called negative latent image, that is formed by applying the laser beam 3Y to the photosensitive layer so that the specific resistance of the irradiated portion is lowered to cause charges to flow on the surface of the photoreceptor 1Y and cause charges to stay in a portion to which the laser beam 3Y is not applied.

The electrostatic latent image that is formed in this manner on the photoreceptor 1Y is rotated to a development position with the travelling of the photoreceptor 1Y. The electrostatic latent image on the photoreceptor 1Y is visualized (to form a developed image) at the development position by the developing device 4Y.

In the developing device 4Y, a yellow toner including, for example, at least a yellow colorant, a crystalline resin and an amorphous resin and having a volume average particle size of 7 μm is contained. The yellow toner is frictionally charged by being stirred in the developing device 4Y to have a charge with the same polarity (negative polarity) as the charge that is on the photoreceptor 1Y, and is thus held on the developer roll (developer holding member). By allowing the surface of the photoreceptor 1Y to pass through the developing device 4Y, the yellow toner is electrostatically adhered to a latent image portion having no charge on the surface of the photoreceptor 1Y, whereby the latent image is developed with the yellow toner. Next, the photoreceptor 1Y having a yellow toner image formed thereon travels and the developed toner image on the photoreceptor 1Y is transported to a primary transfer position.

When the yellow toner image on the photoreceptor 1Y is transported to the primary transfer position, a primary transfer bias is applied to the primary transfer roller 5Y and an electrostatic force toward the primary transfer roller 5Y from the photoreceptor 1Y acts on the toner image, whereby the toner image on the photoreceptor 1Y is transferred onto the intermediate transfer belt 20. The transfer bias applied at this time has the opposite polarity (+) of the toner polarity (−) and is controlled to, for example, about +10 μA in the first unit 10Y by the controller (not shown).

On the other hand, the toner remaining on the photoreceptor 1Y is removed and recovered by the photoreceptor cleaning device 6Y.

The primary transfer biases that are applied to the primary transfer rollers 5M, 5C, and 5K of the second unit 10M and the subsequent units are also controlled in the same manner as in the case of the first unit.

In this manner, the intermediate transfer belt 20 onto which the yellow toner image is transferred in the first unit 10Y is sequentially transported through the second to fourth units 10M, 10C, and 10K, and the toner images of respective colors are multiply-transferred in a superimposed manner.

The intermediate transfer belt 20 onto which four color toner images have been multiply-transferred through the first to fourth units reaches a secondary transfer portion which includes the intermediate transfer belt 20, the support roller 24 contacting the inner surface of the intermediate transfer belt 20, and a secondary transfer roller (secondary transfer unit) 26 disposed on the image supporting surface side of the intermediate transfer belt 20. On the other hand, a recording sheet (transfer medium) P is supplied to a gap between the secondary transfer roller 26 and the intermediate transfer belt 20, which are pressed against each other, by a supply mechanism, and a secondary transfer bias is applied to the support roller 24. The transfer bias applied at this time has the same polarity (−) as the toner polarity (−) and an electrostatic force toward the recording sheet P from the intermediate transfer belt 20 acts on the toner image, whereby the toner image on the intermediate transfer belt 20 is transferred onto the recording sheet P. The secondary transfer bias is determined depending on the resistance detected by a resistance detector (not shown) that detects the resistance of the secondary transfer portion, and is voltage-controlled.

Thereafter, the recording sheet P is fed to the fixing device (fixing unit) 28, the toner image is heated, and the color-superimposed toner image is melted and fixed onto the recording sheet P. The recording sheet P on which the fixing of the color image is completed is transported toward the discharge portion, and a series of the color image forming operations ends.

The image forming apparatus exemplified as above has a configuration in which the toner image is transferred onto the recording sheet P via the intermediate transfer belt 20. However, the invention is not limited to this configuration, and may have a structure in which the toner image may be transferred directly onto the recording sheet from the photoreceptor.

<Process Cartridge, Toner Cartridge>

Figure 3:
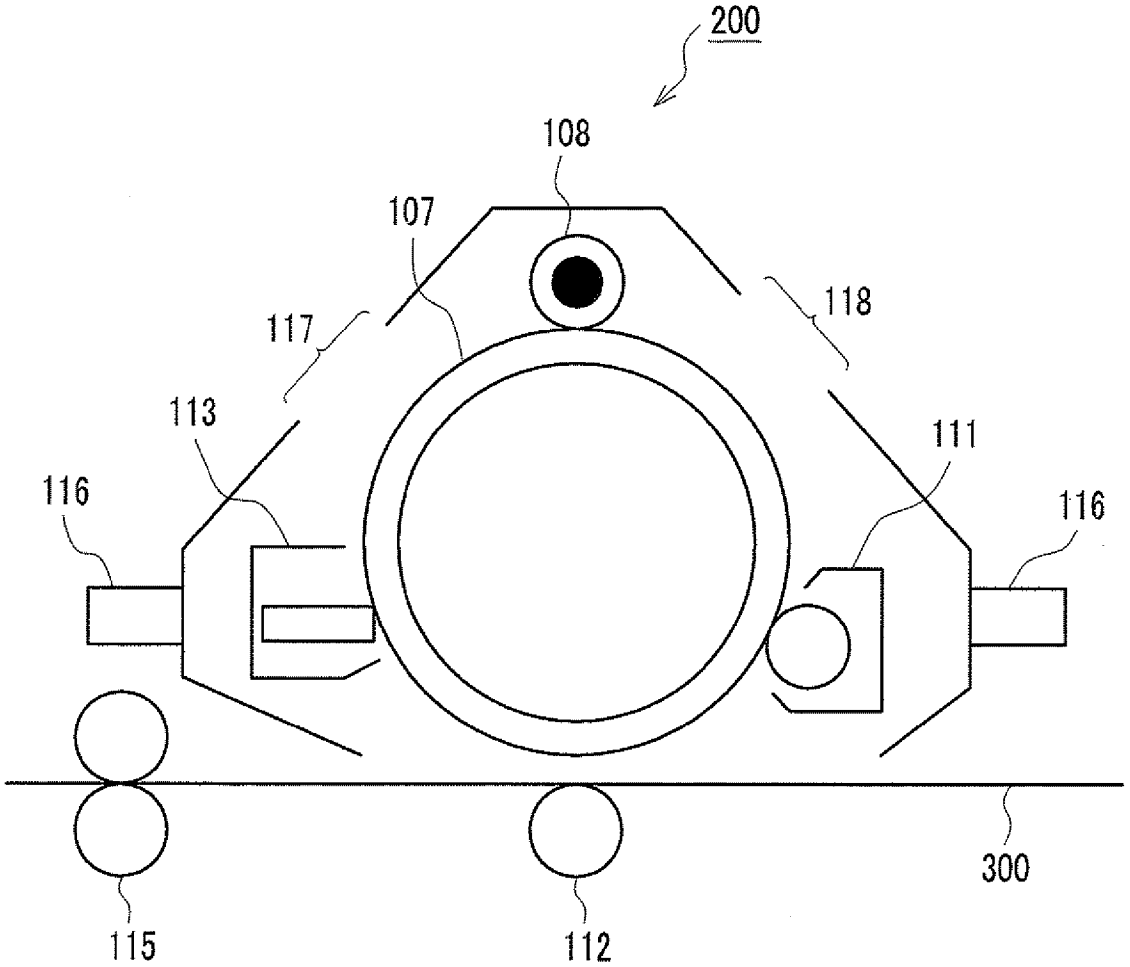
FIG. 3 is a diagram schematically showing the configuration of an example of a process cartridge that is appropriately used in the exemplary embodiment.

FIG. 3 is a diagram schematically showing the configuration of an appropriate example of a process cartridge that contains the developer for electrostatic latent image development according to this exemplary embodiment. A process cartridge 200 has, in addition to a photoreceptor 107, a charging roller 108, a developing device 111 provided with a developer holding member 111A, a photoreceptor cleaning device (cleaning unit) 113, an opening portion 118 for exposure, and an opening portion 117 for erasing exposure, and there are combined and integrated using an attachment rail 116.

The process cartridge 200 is detachably mounted on an image forming apparatus body including a transfer device 112, a fixing device 115 and other constituent portions (not shown), and constitutes an image forming apparatus forming an image on a recording sheet 300 together with the image forming apparatus body.

The process cartridge 200 shown in FIG. 3 includes the charging roller 108, the developing device 111, the cleaning device (cleaning unit) 113, the opening portion 118 for exposure, and the opening portion 117 for erasing exposure, but these devices may be selectively combined. The process cartridge according to this exemplary embodiment may include at least the developing device 111 provided with the developer holding member 111A and include at least one selected from the group consisting of the photoreceptor 107, the charging roller 108, the cleaning device (cleaning unit) 113, the opening portion 118 for exposure, and the opening portion 117 for erasing exposure.

A toner cartridge according to this exemplary embodiment will be described. The toner cartridge is detachably mounted on an image forming apparatus, and at least, in the toner cartridge that stores a toner to be supplied to a developing unit provided in the image forming apparatus, the toner is the above-described toner according to this exemplary embodiment. In the toner cartridge according to this exemplary embodiment, at least a toner may be accommodated, and depending on the mechanism of the image forming apparatus, for example, a developer may be accommodated.

Accordingly, in an image forming apparatus having a configuration in which a toner cartridge is detachably mounted, the toner according to this exemplary embodiment is easily supplied to a developing device by using a toner cartridge containing an accommodating portion that accommodates the toner according to this exemplary embodiment.

The image forming apparatus shown in FIG. 2 is an image forming apparatus that has a configuration in which the toner cartridges 8Y, 8M, 8C, and 8K are detachably mounted. The developing devices 4Y, 4M, 4C, and 4K are connected to the toner cartridges corresponding to the respective developing devices (colors) via toner supply tubes (not shown). In addition, when the toner stored in the toner cartridge runs low, the toner cartridge may be replaced.

(Image Forming Method)

Next, an image forming method using the toner according to this exemplary embodiment will be described. The toner according to this exemplary embodiment is used in a known image forming method using an electrophotographic system. Specifically, the toner is used in an image forming method having the following processes.

That is, a desirable image forming method has: a charging process of uniformly charging a surface of an electrostatic latent image holding member; a latent image forming process of forming a latent image on the charged surface of the electrostatic latent image holding member; a developing process of developing the latent image formed on the surface of the electrostatic latent image holding member by a developer including at least a toner to form a toner image; a transfer process of transferring the toner image formed on the surface of the electrostatic latent image holding member onto a transfer medium; a fixing process of fixing the toner image transferred onto the transfer medium; and a cleaning process of removing the toner remaining on the surface of the electrostatic latent image holding member after transfer, and uses the above-described toner according to this exemplary embodiment as the toner. In addition, in the transfer process, an intermediate transfer medium may be used that mediates the transfer of the toner image to the transfer medium from the electrostatic latent latent image holding member.

EXAMPLES

Hereinafter, this exemplary embodiment will be described in more detail using examples and comparative examples, but is not limited to the examples.

In the following examples, "parts" represents "parts by weight" and "%" represents "% by weight" unless specifically noted.

(Measurement Method)

<Element Analysis>

The contents of the elements A and B in the toner may be measured by the following method. That is, using a scanning fluorescent X-ray analyzer (Rigaku ZSX Primus II), a disk having a toner amount of 0.130 g is molded, the measurement is performed by a qualitative and quantitative total elemental analysis method under the conditions of a X-ray output of from 40 mA to 70 mA, a measurement area of 10 mmϕ, and a measurement time of 15 minutes, and the analysis values of EuLα and BiLα of the data are set as the element amounts according to this exemplary embodiment. When the peak overlaps with a peak of another element, it may be analyzed by ICP emission spectroscopy or an atomic absorption method, and then the content of europium and the content of bismuth may be obtained.

In addition, regarding Sn and Ti, the measurement is performed by energy dispersive X-ray analysis. The toner is embedded in an epoxy resin and frozen by a cryostat, and a thin film is cut out. It is observed using transmission electron microscope-energy dispersive X-ray analysis (TEM-EDX) at an accelerating voltage of 10 kV for an integrated time of 30 minutes. From the obtained toner cross-section observation photography (ten-thousand-fold), an analysis value in an image analyzer is set as the amount of the element.

<Method of Measuring Volume Average Particle Size of Carrier and Volume Average Particle Size of Toner>

The volume average particle size of a carrier is measured using an electronic microscope (SEM). Specifically, an image is obtained by SEM, and then a particle size (maximum length portion) $r_1$ is measured for each particle. 100 particle sizes are measured, and then $r_1$ to $r_{100}$ are expressed in terms of spherical size to obtain volumes, and the value corresponding to 50% from the first volume to the one-hundred-th volume is set as the volume average particle size.

The volume average particle size of a toner is measured using Coulter Multisizer II (manufactured by Beckman Coulter, Inc.). ISOTON-II (manufactured by Beckman Coulter, Inc.) is used as an electrolyte.

As a measurement method, first, 0.5 mg to 50 mg of a measurement sample is added to 2 ml of a surfactant as a dispersant, preferably a 5% aqueous solution of sodium alkylbenzene sulfonate. The resultant material is added to 100 ml to 150 ml of the electrolyte. The electrolyte in which the measurement sample is suspended is subjected to a dispersion treatment for about 1 minute by an ultrasonic dispersing machine, and the particle size distribution of particles having a particle size in the range of from 2.0 μm to 60 μm is measured by the Coulter Multisizer II with the use of an aperture having an aperture diameter of 100 μm. The number of particles to be measured is 50,000.

The measured particle size distribution is accumulated to draw a cumulative distribution from the smallest diameter side for the weight or the volume relative to divided particle size ranges (channels), and the particle size corresponding to 50% in accumulation is defined as a weight average particle size or a volume average particle size.

(Synthesis of Complex Powder A)

40 parts of an ethanol solution (solution A) containing 0.5 part of vanadium oxide acetylacetonate is obtained. After nitrogen substitution of the solution A, heating is started and the temperature is maintained to 90° C. 40 parts of an ethanol solution (solution B) containing 1 part of yttrium acetylacetonate trihydrate and 0.09 part of europium oxalate hexahydrate is prepared and added to the solution A. After stirring for 15 minutes, 10 parts of a solution (solution C) in which 0.05 part of bismuth nitrate is dissolved in pure water is dropped in drops to the solution A over 30 minutes. Stirring is performed while the temperature of the system is maintained to 90° C. and aging is performed for 5 hours. Then, the solvent is removed by distillation under reduced pressure. A powder obtained in this manner is vacuum-dried to obtain a complex powder A. The volume average particle size of the obtained complex powder A is 241 nm, and when the powder is subjected to the measurement by fluorescent X-ray analysis, it is confirmed that the powder is a material including europium, bismuth, and yttrium elements. The result is shown in Table 1.

(Synthesis of Complex Powder B)

40 parts of an ethanol solution (solution A) containing 0.8 part of yttrium oxide is obtained. After nitrogen substitution of the solution A, heating is started and the temperature is maintained to 85° C. 40 parts of an ethanol solution (solution B) containing 0.12 part of europium oxalate hexahydrate is prepared and added to the solution A. After stirring for 15 minutes, 10 parts of a solution (solution C) in which 0.08 part of bismuth nitrate is dissolved in pure water is dropped in drops to the solution A over 30 minutes. Stirring is performed while the temperature of the system is maintained to 85° C. and aging is performed for 5 hours. Then, the solvent is removed by distillation under reduced pressure. A powder obtained in this manner is vacuum-dried to obtain a complex powder B. The volume average particle size of the obtained complex powder B is 299 nm, and when the powder is subjected to the measurement by fluorescent X-ray analysis, it is confirmed that the powder is a material including europium, bismuth, and yttrium elements. The result is shown in Table 1.

(Synthesis of Complex Powder C)

A complex powder C is obtained in a manner similar to that for the complex powder B, except that in place of the nitrogen substitution of the solution A, the atmosphere is changed to a sulfur atmosphere, and then a solution B and a solution C are added and aging is performed in the synthesis of the complex powder B. The volume average particle size of the obtained complex powder C is 309 nm, and when the powder is subjected to the measurement by fluorescent X-ray analysis, it is confirmed that the powder is a material including europium, bismuth, and yttrium elements. The result is shown in Table 1.

(Synthesis of Complex Powder D)

A complex powder D is obtained in a manner similar to that for the complex powder A, except that the solution A is changed to 100 parts of an ethanol solution (solution A) containing 6.5 parts of vanadium oxide acetylacetonate and the solution B is changed to 100 parts of an ethanol solution containing 13 parts of yttrium acetylacetonate trihydrate and 1.2 parts of europium oxalate hexahydrate in the synthesis of the complex powder A. The volume average particle size of the obtained complex powder D is 256 nm, and when the powder is subjected to the measurement by fluorescent X-ray analysis, it is confirmed that the powder is a material including europium, bismuth, yttrium and sulfur elements. The result is shown in Table 1.

(Synthesis of Complex Powder E)

A complex powder E is obtained in a manner similar to that for the complex powder A, except that the solution A is changed to 40 parts of an ethanol solution containing 0.09 part of vanadium oxide acetylacetonate and the solution B is changed to 40 parts of an ethanol solution containing 0.2 part of yttrium acetylacetonate trihydrate and 0.015 part of europium oxalate hexahydrate in the synthesis of the complex powder A. The volume average particle size of the obtained complex powder E is 235 nm, and when the powder is subjected to the measurement by fluorescent X-ray analysis, it is confirmed that the powder is a material including europium, bismuth, and yttrium elements. The result is shown in Table 1.

(Synthesis of Complex Powder F)

A complex powder F is obtained in a manner similar to that for the complex powder A, except that the solution A is changed to 60 parts of an ethanol solution (solution A) containing 3 parts of vanadium oxide acetylacetonate, the solution B is changed to 60 parts of an ethanol solution containing 6 parts of yttrium acetylacetonate trihydrate and 0.54 part of europium oxalate hexahydrate, and the solution C is changed to 30 parts of a solution (solution C) in which 0.4 part of bismuth nitrate is dissolved in pure water in the synthesis of the complex powder A. The volume average particle size of the obtained complex powder F is 288 nm, and when the powder is subjected to the measurement by fluorescent X-ray analysis, it is confirmed that the powder is a material including europium, bismuth, and yttrium elements. The result is shown in Table 1.

(Synthesis of Complex Powder G)

A complex powder G is obtained in a manner similar to that for the complex powder A, except that the solution A is changed to 40 parts of an ethanol solution containing 0.15 part of vanadium oxide acetylacetonate, the solution B is changed to 40 parts of an ethanol solution containing 0.4 part of yttrium acetylacetonate trihydrate and 0.03 part of europium oxalate hexahydrate, and the solution C is changed to 10 parts of a solution in which 0.5 part of bismuth nitrate is dissolved in pure water in the synthesis of the complex powder A. The volume average particle size of the obtained complex powder G is 354 nm, and when the powder is subjected to the measurement by fluorescent X-ray analysis, it is confirmed that the powder is a material including europium, bismuth, and yttrium elements. The result is shown in Table 1.

(Complex Powder H)

A complex powder H is obtained in a manner similar to that for the complex powder A, except that the solution A is changed to 40 parts of an ethanol solution containing 1 part of vanadium oxide acetylacetonate, the solution B is changed to 40 parts of an ethanol solution containing 2 parts of yttrium acetylacetonate trihydrate and 0.18 part of europium oxalate hexahydrate, and the solution C is changed to 10 parts of a solution in which 0.35 part of bismuth nitrate is dissolved in pure water in the synthesis of the complex powder A. The volume average particle size of the obtained complex powder H is 198 nm, and when the powder is subjected to the measurement by fluorescent X-ray analysis, it is confirmed that the powder is a material including europium, bismuth, and yttrium elements. The result is shown in Table 1.

(Complex Powder I)

A complex powder I is obtained in a manner similar to that for the complex powder A, except that the solution A is changed to 40 parts of an ethanol solution containing 0.3 part of vanadium oxide acetylacetonate, the solution B is changed to 40 parts of an ethanol solution containing 1.2 parts of yttrium acetylacetonate trihydrate and 0.045 part of europium oxalate hexahydrate, and the solution C is changed to 10 parts of a solution in which 0.35 part of bismuth nitrate is dissolved in pure water in the synthesis of the complex powder A. The volume average particle size of the obtained complex powder I is 276 nm, and when the powder is subjected to the measurement by fluorescent X-ray analysis, it is confirmed that the powder is a material including europium, bismuth, and yttrium elements. The result is shown in Table 1.

(Complex Powder J)

A complex powder J is obtained in a manner similar to that for the complex powder A, except that the solution A is changed to 40 parts of an ethanol solution containing 1 part of vanadium oxide acetylacetonate and the solution B is changed to 40 parts of an ethanol solution containing 2 parts of yttrium acetylacetonate trihydrate and 0.18 part of europium oxalate hexahydrate in the synthesis of the complex powder A. The volume average particle size of the obtained complex powder J is 243 nm, and when the powder is subjected to the measurement by fluorescent X-ray analysis, it is confirmed that the powder is a material including europium, bismuth, and yttrium elements. The result is shown in Table 1.

(Complex Powder K)

A complex powder K is obtained in a manner similar to that for the complex powder A, except that the solution A is changed to 40 parts of an ethanol solution containing 0.8 part of vanadium oxide acetylacetonate, the solution B is changed to 40 parts of an ethanol solution containing 1.6 parts of yttrium acetylacetonate trihydrate and 0.15 part of europium oxalate hexahydrate, and the solution C is changed to 10 parts of a solution in which 0.1 part of bismuth nitrate is dissolved in pure water in the synthesis of the complex powder A. The volume average particle size of the obtained complex powder K is 232 nm, and when the powder is subjected to the measurement by fluorescent X-ray analysis, it is confirmed that the powder is a material including europium, bismuth, and yttrium elements. The result is shown in Table 1.

(Complex Powder L)

40 parts of an ethanol solution (solution A) containing 0.7 part of vanadium oxide acetylacetonate is obtained. After nitrogen substitution of the solution A, heating is started and the temperature is maintained to 90° C. 40 ml of an ethanol solution (solution B) containing 1.2 parts of yttrium acetylacetonate trihydrate and 0.12 part of europium oxalate hexahydrate is prepared and added to the solution A. Stirring is performed while the temperature of the system is maintained to 90° C. and aging is performed for 5 hours. Then, the solvent is removed by distillation under reduced pressure. A powder obtained in this manner is vacuum-dried to obtain a complex powder L. The volume average particle size of the obtained complex powder L is 186 nm, and when the powder is subjected to the measurement by fluorescent X-ray analysis, it is confirmed that the powder is a material including europium and yttrium elements. The result is shown in Table 1.

(Complex Powder M)

40 parts of an ethanol solution (solution A) containing 0.8 part of vanadium oxide acetylacetonate is obtained. After nitrogen substitution of the solution A, heating is started and the temperature is maintained to 90° C. 40 parts of an ethanol solution (solution B) containing 1.3 parts of yttrium acetylacetonate trihydrate is prepared and added to the solution A. After stirring for 15 minutes, 10 parts of a solution (solution C) in which 0.09 part of bismuth nitrate is dissolved in pure water is dropped in drops to the solution A over 30 minutes. Stirring is performed while the temperature of the system is maintained to 90° C. and aging is performed for 7 hours. Then, the solvent is removed by distillation under reduced pressure. A powder obtained in this manner is vacuum-dried to obtain a complex powder M. The volume average particle size of the obtained complex powder M is 205 nm, and when the powder is subjected to the measurement by fluorescent X-ray analysis, it is confirmed that the powder is a material including bismuth and yttrium elements. The result is shown in Table 1.

TABLE 1

| | Complex Kind | Fluorescent X-ray Eu Amount A (% by weight) | Fluorescent X-ray Bi Amount B (% by weight) | Eu Amount/Bi Amount (A/B) | Particle Size (nm) |
|---|---|---|---|---|---|
| Complex Powder A | $YVO_4$ | 13.2 | 2.42 | 5.5 | 241 |
| Complex Powder B | $Y_2O_3$ | 15.1 | 1.94 | 7.8 | 299 |
| Complex Powder C | $Y_2O_2S$ | 12.8 | 1.79 | 7.2 | 309 |

TABLE 1-continued

| | Complex Kind | Fluorescent X-ray Eu Amount A (% by weight) | Fluorescent X-ray Bi Amount B (% by weight) | Eu Amount/Bi Amount (A/B) | Particle Size (nm) |
|---|---|---|---|---|---|
| Complex Powder D | $YVO_4$ | 49.6 | 6.02 | 8.2 | 256 |
| Complex Powder E | $YVO_4$ | 2.1 | 0.61 | 3.5 | 235 |
| Complex Powder F | $YVO_4$ | 38.7 | 8.51 | 4.5 | 288 |
| Complex Powder G | $YVO_4$ | 4.0 | 0.23 | 17.2 | 354 |
| Complex Powder H | $YVO_4$ | 26.3 | 1.24 | 21.2 | 198 |
| Complex Powder I | $YVO_4$ | 5.5 | 13.8 | 0.4 | 276 |
| Complex Powder J | $YVO_4$ | 23.5 | 1.76 | 13.4 | 243 |
| Complex Powder K | $YVO_4$ | 20.8 | 3.72 | 5.6 | 232 |
| Complex Powder L | $YVO_4$ | 21.8 | — | — | 186 |
| Complex Powder M | $YVO_4$ | — | 2.86 | — | 205 |

(Preparation of Toner 1)

Polyester Resin (polyester resin that is synthesized using a tin catalyst including propylene oxide 2-mol adduct/ethylene oxide 2-mol adduct of bisphenol A, terephthalic acid and trimellitic acid as major components): 171.0 parts Magenta Pigment (Pigment Red 122: manufactured by Dainichiseika Color & Chemicals Mfg. Co., Ltd.): 14.0 parts Release Agent (Polypropylene; manufactured by Mitsui Chemicals, Inc., Mitsui HI-WAX NP055): 5.0 parts Complex Powder A: 10.0 parts The above components are mixed by a Henschel mixer, and then the kneading is carried out by a continuous kneader (2-axis extruder) having the screw structure shown in FIG. 1 under the following conditions. The rotation rate of the screw is set to 500 rpm.

Setting Temperature of Feeding Portion (Blocks 12A and 12B): 20° C.

Kneading Setting Temperature (Blocks 12C to 12E) of Kneading Portion 1: 100° C.

Kneading Setting Temperature (Blocks 12F to 12J) of Kneading Portion 2: 110° C.

Amount of Aqueous Medium (distilled water) Added (with respect to 100 parts of Raw Material Supply Amount): 1.5 parts At this time, the temperature of the kneaded material in the discharge port (discharge port 18) is 120° C.

The kneaded material is rapidly cooled by a mill roll in which brine of −5° C. passes and a slab insertion-type cooling belt for cooling with cold water of 2° C. After cooling, crushing is performed by a hammer mill. The rapid cooling rate is confirmed by changing the speed of the cooling belt and the average temperature decrease rate is 10° C./sec.

Thereafter, pulverization is performed by a pulverizer with a built-in coarse particle classifier (AFG 400) to obtain pulverized particles. Then, classification is performed by an inertia-type classifier to remove fine particles and coarse particles, and thus toner particles 1 having a volume average particle size of 6.0 μm are obtained.

1.5 parts of a titanium compound that is treated with 40 parts of isobutyl trimethoxysilane with respect to 100 parts of metatitanic acid and 1.2 parts of spherical silica that is treated with hexamethyldisilazane of 130 nm are added to the obtained toner particles and mixed for 10 minutes by a Henschel mixer (external addition blending). Then, by a wind classifier (hi-bolter), 45 μm-sieving is performed to obtain toner 1. The result is shown in Table 2.

(Preparation of Toner 2)

Toner particles 2 having a volume average particle size of 7.4 μm are obtained in a manner similar to that for the toner 1, except that the complex powder A is changed to the complex powder B in the preparation of the toner 1. The external addition and sieving processes are performed in a manner similar to that for the toner particles 1 to obtain the toner 2. The result is shown in Table 2.

(Preparation of Toner 3)

Toner particles 3 having a volume average particle size of 5.8 μm are obtained in a manner similar to that for the toner 1, except that the complex powder A is changed to the complex powder C in the preparation of the toner 1. The external addition and sieving processes are performed in a manner similar to that for the toner particles 1 to obtain the toner 3. The result is shown in Table 2.

(Preparation of Toner 4)

Toner particles 4 having a volume average particle size of 6.2 μm are obtained in a manner similar to that for the toner 1, except that the polyester resin is changed to a polyester resin (polyester resin that is synthesized by a titanium catalyst including propylene oxide 2-mol adduct/ethylene oxide 2-mol adduct of bisphenol A, terephthalic acid and trimellitic acid as major components) in the preparation of the toner 1. The external addition and sieving processes are performed in a manner similar to that for the toner particles 1 to obtain the toner 4. The result is shown in Table 2.

(Preparation of Toner 5)

Toner particles 5 having a volume average particle size of 4.8 μm are obtained in a manner similar to that for the toner 1, except that the complex powder A is changed to the complex powder D in the preparation of the toner 1. The external addition and sieving processes are performed in a manner similar to that for the toner particles 1 to obtain the toner 5. The result is shown in Table 2.

(Preparation of Toner 6)

Toner particles 6 having a volume average particle size of 8.2 μm are obtained in a manner similar to that for the toner 1, except that the complex powder A is changed to the complex powder E in the preparation of the toner 1. The external addition and sieving processes are performed in a manner similar to that for the toner particles 1 to obtain the toner 6. The result is shown in Table 2.

(Preparation of Toner 7)

Toner particles 7 having a volume average particle size of 6.9 μm are obtained in a manner similar to that for the toner 1, except that the complex powder A is changed to the complex powder F in the preparation of the toner 1. The external addition and sieving processes are performed in a manner similar to that for the toner particles 1 to obtain the toner 7. The result is shown in Table 2.

(Preparation of Toner 8)

Toner particles 8 having a volume average particle size of 3.9 μm are obtained in a manner similar to that for the toner 1, except that the complex powder A is changed to the complex powder G in the preparation of the toner 1. The external addition and sieving processes are performed in a manner similar to that for the toner particles 1 to obtain the toner 8. The result is shown in Table 2.

(Preparation of Toner 9)

Toner particles 9 having a volume average particle size of 9.5 μm are obtained in a manner similar to that for the toner 1, except that the complex powder A is changed to the complex powder H in the preparation of the toner 1. The external addition and sieving processes are performed in a manner similar to that for the toner particles 1 to obtain the toner 9. The result is shown in Table 2.

(Preparation of Toner 10)

Toner particles 10 having a volume average particle size of 6.0 μm are obtained in a manner similar to that for the toner 1, except that the complex powder A is changed to the complex powder I in the preparation of the toner 1. The external addition and sieving processes are performed in a manner similar to that for the toner particles 1 to obtain the toner 10. The result is shown in Table 2.

(Preparation of Toner 11)

Toner particles 11 having a volume average particle size of 21.0 μm are obtained in a manner similar to that for the toner 1, except that the coarse particles are recovered by an inertia-type classifier in the preparation of the toner 1. The external addition and sieving processes are performed in a manner similar to that for the toner particles 1 to obtain the toner 11. The result is shown in Table 2.

(Preparation of Toner 12)

Toner particles 12 having a volume average particle size of 1.8 μm are obtained in a manner similar to that for the toner 1, except that the fine particles are recovered by an inertia-type classifier in the preparation of the toner 1. The external addition and sieving processes are performed in a manner similar to that for the toner particles 1 to obtain the toner 12. The result is shown in Table 2.

(Preparation of Toner 13)

—Preparation of Styrene Acrylic Resin (Styrene-Butyl Acrylate Copolymer)—

90 parts of styrene and 10 parts of butyl acrylate are polymerized under cumene reflux (from 146 to 156° C., in the presence of 0.01 part of Sn) in a reactor to synthesize a styrene acrylic resin that is a styrene-butyl acrylate copolymer.

—Preparation of Toner 13—

Toner particles 13 having a volume average particle size of 7.2 μm are obtained in a manner similar to that for the toner 1, except that the polyester resin is changed to the above-described styrene acrylic resin in the preparation of the toner 1. The external addition and sieving processes are performed in a manner similar to that for the toner particles 1 to obtain the toner 13. The result is shown in Table 2.

(Preparation of Toner 14)

Toner particles 14 having a volume average particle size of 8.6 μm are obtained in a manner similar to that for the toner 1, except that the complex powder A is changed to the complex powder J in the preparation of the toner 1. The external addition and sieving processes are performed in a manner similar to that for the toner particles 1 to obtain the toner 14. The result is shown in Table 2.

(Preparation of Toner 15)

Toner particles 15 having a volume average particle size of 5.7 μm are obtained in a manner similar to that for the toner 1, except that the complex powder A is changed to the complex powder K in the preparation of the toner 1. The external addition and sieving processes are performed in a manner similar to that for the toner particles 1 to obtain the toner 15. The result is shown in Table 2.

(Preparation of Toner 16)

—Preparation of Polyester Resin Particle Dispersion (1)—

100 parts of a polyester resin (polyester resin that is synthesized using a tin catalyst including propylene oxide 2-mol adduct/ethylene oxide 2-mol adduct of bisphenol A, terephthalic acid and trimellitic acid as major components), 50 parts of methyl ethyl ketone, 30 parts of isopropyl alcohol, and 5 parts of a 10% aqueous ammonia solution are put into a separable flask and mixed sufficiently to be dissolved. Then, while performing heating stirring at 40° C., ion exchange water is dropped in drops at a liquid sending rate of 8 g/min using a liquid sending pump.

The solution in the flask is made uniformly cloudy, and then the liquid sending rate is raised to 25 g/min to cause phase inversion, and when the liquid sending amount is 135 parts, the dropping is stopped. Thereafter, the solvent is removed under reduced pressure to obtain a polyester resin particle dispersion (1). The volume average particle size of the obtained polyester resin particles is 158 nm, and the solid content concentration of the resin particles is 39%.

—Preparation of Release Agent Dispersion (1)—

Ester Wax WEP 5 (manufactured by NOF Corporation): 500 parts

Anionic Surfactant (Daiichi Kogyo Seiyaku Co., Ltd: NEOGEN RK): 50 parts

Ion Exchange Water: 2000 parts

The above components are heated to 110° C. and dispersed using a homogenizer (IKA Works Gmbh & Co. KG: Ultra Turrax T50). Then, a dispersion treatment is performed by a Manton-Gaulin high-pressure homogenizer (Gaulin Corporation) to prepare a release agent dispersion (1) (release agent concentration: 23%) in which a dispersion having an average particle size of 0.24 μm is dispersed.

—Preparation of Colorant Dispersion (1)—

Magenta Pigment (Pigment Red 122: manufactured by Dainichiseika Color & Chemicals Mfg. Co., Ltd.): 100 parts Anionic Surfactant (manufactured by Daiichi Kogyo Seiyaku Co., Ltd: NEOGEN R): 15 parts Ion Exchange Water: 900 parts The above components are mixed, dissolved, and dispersed for about 1 hour by using a high-pressure impact-type dispersing machine ULTIMIZER (manufactured by Sugino Machine Ltd., HJP30006) to prepare a colorant dispersion (1) in which the colorant (magenta pigment) is dispersed.

The average particle size of the colorant (magenta pigment) in the colorant dispersion (1) is 0.13 μm, and the colorant particle concentration is 25%.

—Preparation of Toner 16—

Polyester Resin Particle Dispersion (1): 280 parts

Colorant Dispersion (1): 28 parts

Complex Powder A: 20 parts

Anionic Surfactant (dowfax 2A1, 20% aqueous solution): 8 parts

Release Agent Dispersion (1): 60 parts

Among the above raw materials, the polyester resin particle dispersion (1), anionic surfactant, and 340 parts of ion exchange water are put into a polymerization tank provided with a pH meter, a stirring blade and a thermometer, and are stirred for 15 minutes at 150 rpm.

Next, the colorant dispersion (1) and the release agent dispersion (1) are added and mixed, and then a 0.3 M-nitric acid aqueous solution is added to the raw material mixture to obtain a raw material dispersion prepared to have a pH of 4.2.

While a shear force is applied to the raw material dispersion at 3,000 rpm by Ultra Turrax, 27 parts of a nitric acid aqueous solution containing 1% of aluminum sulfate are dropped in drops as a flocculant. During the dropping of the flocculant, the viscosity of the raw material dispersion rapidly increases. Accordingly, at the time when the viscosity increases, the drop rate is reduced to uniformly distribute the flocculant. When the dropping of the flocculant ends, the rotation rate is further raised to 5,000 rpm and the stirring is performed for 5 minutes.

While being warmed to 30° C. by a mantle heater, the raw material dispersion is stirred at from 350 to 600 rpm. After stirring for 30 minutes, stable formation of a primary particle size is confirmed using Coulter Counter [TA-II] (aperture diameter: 50 μm; manufactured by Beckman Coulter, Inc.), and then the temperature is raised up to 42° C. at 0.1° C./min to grow aggregated particles. With the confirmation of the growth of aggregated particles as necessary by using Coulter Counter, the appropriate aggregation temperature and rotation rate of stirring are adjusted by the aggregation rate.

Meanwhile, in order to form a coating layer on the surface of an aggregated particle, 30 parts of ion exchange water and 4.2 parts of an anionic surfactant (dowfax 2A1, 20% aqueous solution) are added to 110 parts of a polyester resin particle dispersion (1) and mixed to provide a solution prepared to have a pH of 3.3 in advance.

When the aggregated particles are grown to have a volume average particle size of 5.4 μm, a solution for forming a coating layer prepared in advance is added and held for 10 minutes while being stirred. Thereafter, in order to stop the growth of the aggregated particles having a coating layer formed thereon, 1.5 pph of ethylenediaminetetraacetic acid (EDTA) is added with respect to a total amount of the dispersion put into the polymerization tank, and then 1 mol/L of a sodium hydroxide aqueous solution is added to control the pH of the raw material dispersion to 7.5.

Next, in order to fuse the aggregated particles together, the temperature is raised up to 85° C. at a temperature increase rate of 1° C./min while the pH is adjusted to 7.5. The pH is still adjusted to 7.5 to advance the fusion even after raising to 85° C., and after confirmation of the fusion of the aggregated particles by an optical microscope, ice water is injected for rapid cooling at a temperature decrease rate of 10° C./min in order to stop the growth of the particle size.

Thereafter, for the purpose of washing the obtained particles, sieving is performed once with a 15 μm-opening mesh. Next, ion exchange water (30° C.) is added in an amount about 10 times the solid content and stirred for 20 minutes, and is then filtered. Furthermore, the solid content remaining on filter paper is dispersed in a slurry, repeatedly washed four times by ion exchange water of 30° C., and then dried to obtain toner base particles 16 having a volume average particle size of 6.1 μm.

Then, with respect to 100 parts of the obtained toner base particles, 1 part of gas phase method silica (manufactured by Nippon Aerosil Co., Ltd., R972) is mixed by a Henschel mixer (for 10 minutes at 25 m/s) to be externally added, and thus a toner 16 is obtained. The result is shown in Table 2.

(Preparation of Toner 17)

—Preparation of Polyester Resin 1 not Containing Tin and Titanium—

1,4-cyclohexanedicarboxylic acid: 17.5 parts

Bisphenol A 1 ethylene oxide adduct: 31 parts

Dodecylbenzenesulfonic acid: 0.15 part

The above materials are mixed and put into a reactor provided with a stirrer. The mixture is subjected to polycondensation for 24 hours at 120° C. under a nitrogen atmosphere to obtain a polyester resin 1 not containing tin and titanium.

—Preparation of Toner 17—

Toner particles 17 having a volume average particle size of 6.0 μm are obtained in a manner similar to that for the toner 1, except that the polyester resin is changed to the above-described polyester resin 1 not containing tin and titanium. The external addition and sieving processes are performed in a manner similar to that for the toner particles 1 to obtain the toner 17. The result is shown in Table 2.

(Preparation of Comparative Toner 18)

Comparative toner particles 18 having a volume average particle size of 5.2 μm are obtained in a manner similar to that for the toner 1, except that the complex powder A is changed to the complex powder L in the preparation of the toner 1. The external addition and sieving processes are performed in a manner similar to that for the toner particles 1 to obtain the comparative toner 18. The result is shown in Table 2.

(Preparation of Comparative Toner 19)

Comparative toner particles 19 having a volume average particle size of 4.1 μm are obtained in a manner similar to that for the toner 1, except that the complex powder A is changed to the complex powder M in the preparation of the toner 1. The external addition and sieving processes are performed in a manner similar to that for the toner particles 1 to obtain the comparative toner 19. The result is shown in Table 2.

(Preparation of Comparative Toner 20)

Comparative toner particles 20 having a volume average particle size of 10.5 μm are obtained in a manner similar to that for the toner 1, except that the complex powder A is not used in the preparation of the toner 1. The external addition and sieving processes are performed in a manner similar to that for the toner particles 1 to obtain the comparative toner 20. The result is shown in Table 2.

(Evaluation Method)

<Preparation of Developer>

(Preparation of Developers 1 to 17 and Comparative Developers 1 to 3)

100 parts of a carrier 1 and 7 parts of an external additive toner are mixed for 20 minutes at 40 rpm by a V-blender to prepare developers 1 to 17 and comparative developers 1 to 3.

<Color Retentivity Evaluation>

Using the obtained developers 1 to 17 and comparative developers 18 to 20, an image obtained by copying a Japan color standard printing patch for sheet-fed printing is left for 10 days under a high-strength white lamp by Docu Print Color 400 CP manufactured by Fuji Xerox Co., Ltd. Using a reflection concentration meter X-rite 404 manufactured by X-Rite, Co., Ltd., the amount of change of ΔE before and after the stress test is calculated. The result is shown in Table 2.

The evaluation standard is as follows.

A: $\Delta E \leq 1$, with respect to the standard sample (judgment is impossible visually, and there are no practical problems at all)

B: $1 < \Delta E \leq 2$, with respect to the standard sample (judgment is impossible visually, and there are no practical problems)

C: $2 < \Delta E \leq 3$, with respect to the standard sample (judgment is possible visually, and there are practical problems)

D: $3 < \Delta E$, with respect to the standard sample (clear judgment is possible visually, and there are practical problems)

<Color Developability>

Using the obtained developers 1 to 17 and comparative developers 1 to 3, a ΔE difference of a Japan color standard printing patch for sheet-fed printing and a copied image of the patch is calculated by using a reflection concentration meter X-rite 404 manufactured by X-Rite, Co. by Docu Print Color 400 CP manufactured by Fuji Xerox Co., Ltd. The result is shown in Table 2.

The evaluation standard is as follows.

A: $\Delta E \leq 1$ (judgment is impossible visually, and there are no practical problems at all)

B: $1 < \Delta E \leq 2$ (judgment is impossible visually, and there are no practical problems)

C: $2 < \Delta E \leq 3$ (judgment is possible visually, and there are practical problems)

D: $3 < \Delta E$ (clear judgment is possible visually, and there are practical problems)

The result is shown in the following table 2.

TABLE 2

| | Toner | Complex Powder | Fluorescent X-ray Eu Amount A (% by weight) | Fluorescent X-ray Bi Amount B (% by weight) | Eu/Bi (A/B) | Fluorescent X-ray Sn (Ti) Amount C (% by weight) | Eu/Sn (Ti) (A/C) | Toner Particle Size (μm) |
|---|---|---|---|---|---|---|---|---|
| Example 1 | 1 | A | 0.60 | 0.09 | 6.7 | 0.13 | 4.6 | 6.0 |
| Example 2 | 2 | B | 0.73 | 0.092 | 7.9 | 0.09 | 8.1 | 7.4 |
| Example 3 | 3 | C | 0.63 | 0.087 | 7.2 | 0.18 | 3.5 | 5.8 |
| Example 4 | 4 | A | 0.61 | 0.12 | 5.1 | 0.09 | 6.8 | 6.2 |
| Example 5 | 5 | D | 7.01 | 0.62 | 11.3 | 0.35 | 20.0 | 4.8 |
| Example 6 | 6 | E | 0.09 | 0.03 | 3.0 | 0.03 | 3.2 | 8.2 |
| Example 7 | 7 | F | 3.54 | 0.72 | 4.9 | 0.21 | 16.9 | 6.9 |
| Example 8 | 8 | G | 0.17 | 0.009 | 18.9 | 0.04 | 4.3 | 3.9 |
| Example 9 | 9 | H | 1.30 | 0.06 | 21.7 | 0.11 | 11.8 | 9.5 |
| Example 10 | 10 | I | 0.27 | 0.62 | 0.4 | 0.09 | 3.0 | 6.0 |
| Example 11 | 11 | A | 0.54 | 0.08 | 6.8 | 0.13 | 4.2 | 21.0 |
| Example 12 | 12 | A | 0.65 | 0.12 | 5.4 | 0.11 | 5.9 | 1.8 |
| Example 13 | 13 | A | 0.72 | 0.11 | 6.5 | 0.11 | 6.5 | 7.2 |
| Example 14 | 14 | J | 1.10 | 0.08 | 13.8 | 0.05 | 22.0 | 8.6 |
| Example 15 | 15 | K | 1.00 | 0.18 | 5.6 | 0.14 | 7.1 | 5.7 |
| Example 16 | 16 | A | 0.63 | 0.14 | 4.5 | 0.12 | 5.3 | 6.1 |
| Example 17 | 17 | A | 0.62 | 0.12 | 5.2 | — | — | 6.0 |
| Comparative Example 1 | 18 | L | 1.01 | 0.00 | — | 0.15 | 6.7 | 5.2 |
| Comparative Example 2 | 19 | M | 0.00 | 0.12 | — | 0.08 | — | 4.1 |
| Comparative Example 3 | 20 | — | 0.00 | 0.00 | — | 0.18 | — | 10.5 |

| | Binder Resin | Complex Kind | Sn, Ti | Method | Color Retentivity | Color Developability |
|---|---|---|---|---|---|---|
| Example 1 | Polyester Resin | $YVO_4$ | Sn | Kneading Pulverization | A | A |
| Example 2 | Polyester Resin | $Y_2O_3$ | Sn | Kneading Pulverization | A | A |
| Example 3 | Polyester Resin | $Y_2O_2S$ | Sn | Kneading Pulverization | A | A |
| Example 4 | Polyester Resin | $YVO_4$ | Ti | Kneading Pulverization | A | A |
| Example 5 | Polyester Resin | $YVO_4$ | Sn | Kneading Pulverization | B | A |
| Example 6 | Polyester Resin | $YVO_4$ | Sn | Kneading Pulverization | A | B |
| Example 7 | Polyester Resin | $YVO_4$ | Sn | Kneading Pulverization | A | B |
| Example 8 | Polyester Resin | $YVO_4$ | Sn | Kneading Pulverization | B | A |
| Example 9 | Polyester Resin | $YVO_4$ | Sn | Kneading Pulverization | B | A |
| Example 10 | Polyester Resin | $YVO_4$ | Sn | Kneading Pulverization | A | B |
| Example 11 | Polyester Resin | $YVO_4$ | Sn | Kneading Pulverization | B | B |
| Example 12 | Polyester Resin | $YVO_4$ | Sn | Kneading Pulverization | B | A |
| Example 13 | Styrene Acrylic Resin | $YVO_4$ | Sn | Kneading Pulverization | B | B |
| Example 14 | Polyester Resin | $YVO_4$ | Sn | Kneading Pulverization | B | A |
| Example 15 | Polyester Resin | $YVO_4$ | Sn | Kneading Pulverization | A | B |
| Example 16 | Polyester Resin | $YVO_4$ | Sn | Aggregation | A | B |
| Example 17 | Polyester Resin | $YVO_4$ | — | Kneading Pulverization | B | B |
| Comparative Example 1 | Polyester Resin | $YVO_4$ | Sn | Kneading Pulverization | D | C |
| Comparative Example 2 | Polyester Resin | $YVO_4$ | Sn | Kneading Pulverization | C | D |
| Comparative Example 3 | Polyester Resin | $YVO_4$ | Sn | Kneading Pulverization | D | D |

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An electrostatic latent image developing toner comprising:

a binder resin;

a colorant; and a complex comprising europium and bismuth;

wherein a content A of europium in the toner measured by fluorescent X-ray analysis is in a range of from about 0.7% by weight to about 1.5% by weight, and a content B of bismuth in the toner measured by fluorescent X-ray analysis is in a range of from about 0.04% by weight to about 0.7% by weight.

2. The electrostatic latent image developing toner according to claim 1, satisfying the following equation:

$$3 \leq A/B \leq 20$$

wherein A is the content (% by weight) of europium in the toner measured by fluorescent X-ray analysis, and B is the content (% by weight) of bismuth in the toner measured by fluorescent X-ray analysis.

3. The electrostatic latent image developing toner according to claim 1, wherein the binder resin contains a polyester resin.

4. The electrostatic latent image developing toner according to claim 1, further comprising at least one of tin and titanium.

5. The electrostatic latent image developing toner according to claim 4, satisfying the following equation:

$$3 \leq A/C \leq 20$$

wherein A is the content (% by weight) of europium in the toner measured by fluorescent X-ray analysis, and C is the content (% by weight) of at least one of the tin and the titanium in a cross-section of the toner measured by transmission electron microscope energy dispersive X-ray analysis.

6. The electrostatic latent image developing toner according to claim 1, containing at least one of a complex selected from the group consisting of $YVO_4$:Eu,Bi complex, $Y_2O_3$:Eu, Bi complex and $Y_2O_2S$:Eu,Bi complex.

7. The electrostatic latent image developing toner according to claim 1, wherein the colorant is a magenta colorant.

8. An electrostatic latent image developing toner manufacturing method comprising: kneading a toner forming material containing a binder resin, a colorant, and a compound containing europium and bismuth; cooling the kneaded material formed by kneading; pulverizing the kneaded material cooled by the cooling; and classifying the kneaded material pulverized by the pulverizing, to form the electrostatic latent image developing toner according to claim 1.

9. A toner cartridge for an image forming apparatus comprising:

an accommodating portion that accommodates a toner, wherein the toner is the electrostatic latent image developing toner according to claim 1.

10. A toner cartridge for an image forming apparatus comprising:

an accommodating portion that accommodates a toner, wherein the toner is the electrostatic latent image developing toner according to claim 2.

11. An image forming method comprising:

charging a surface of an image holding member;

forming an electrostatic latent image on the surface of the image holding member;

developing the electrostatic latent image formed on the surface of the image holding member by a toner to form a toner image; and transferring the developed toner image onto a transfer medium;

wherein the toner is the electrostatic latent image developing toner according to claim 1.

12. The image forming method according to claim 11, wherein the toner is an electrostatic latent image developing toner satisfying the following equation:

$$3 \leq A/B \leq 20,$$

wherein A is the content (% by weight) of europium in the toner measured by fluorescent X-ray analysis, and B is the content (% by weight) of bismuth in the toner measured by fluorescent X-ray analysis.

* * * * *